US010999670B2

(12) United States Patent
Zalisk et al.

(10) Patent No.: US 10,999,670 B2
(45) **Date of Patent: *May 4, 2021**

(54) EAR TIP SEALING STRUCTURE

(71) Applicant: BOSE CORPORATION, Framingham, MA (US)

(72) Inventors: Michael Andrew Zalisk, Arlington, MA (US); Thomas Aquinas Nilsen, Auburn, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/560,662

(22) Filed: Sep. 4, 2019

(65) Prior Publication Data

US 2020/0221204 A1 Jul. 9, 2020

Related U.S. Application Data

(63) Continuation-in-part of application No. 16/241,045, filed on Jan. 7, 2019, now Pat. No. 10,820,084.

(51) Int. Cl.
*H04R 1/10* (2006.01)

(52) U.S. Cl.
CPC ..... *H04R 1/1016* (2013.01); *H04R 1/105* (2013.01)

(58) Field of Classification Search
CPC .. H04R 1/1016; H04R 1/1066; H04R 25/652; H04R 25/656; H04R 2201/10; H04R 2225/77; H04R 2460/09; H04R 2460/11; H04R 2460/15
See application file for complete search history.

(56) References Cited

U.S. PATENT DOCUMENTS 3,934,100 A * 1/1976 Harada ..... A61B 7/00 181/135
7,113,611 B2 * 9/2006 Leedom ..... H04R 25/65 381/322
7,536,008 B2 * 5/2009 Howes ..... H04R 1/083 379/433.01

(Continued)

FOREIGN PATENT DOCUMENTS

EP 3 082 347 A1 10/2016

OTHER PUBLICATIONS

International Search Report and Written Opinion for International Application No. PCT/US2020/012531 dated Jun. 26, 2020.

*Primary Examiner* — Ryan Robinson
(74) *Attorney, Agent, or Firm* — Patterson + Sheridan, LLP

(57) ABSTRACT

Aspects describe an earpiece with structure for positioning and retaining the earpiece and with structure for sealing against the entrance to the ear canal. According to aspects, the retaining structure has at least one substantially elliptical leg configured to follow the curve of the anti-helix and/or the cymba concha at the rear of the concha. The leg increases in thickness from a tip of the earpiece towards the body of the earpiece. The sealing structure is substantially frusto-conical and extends from a nozzle. The nozzle is angled to align with ear geometry. In an example, he sealing structure has a slight radius on an outer surface of the sealing structure. In another example, the sealing structure has a substantially constant thickness from the nozzle to the wide end of the sealing structure.

19 Claims, 16 Drawing Sheets

(56) References Cited

U.S. PATENT DOCUMENTS

| | | | | |
|---|---|---|---|---|
| D645,458 | S | 9/2011 | Silvestri et al. | |
| 8,121,325 | B2 | 2/2012 | Atamaniuk et al. | |
| D655,693 | S | 3/2012 | Silvestri et al. | |
| 8,208,676 | B2 * | 6/2012 | Murozaki | H04R 1/1016 381/380 |
| 8,249,287 | B2 | 8/2012 | Silvestri et al. | |
| 8,254,621 | B2 | 8/2012 | Silvestri et al. | |
| 8,311,253 | B2 | 11/2012 | Silvestri et al. | |
| 8,503,707 | B2 * | 8/2013 | Urso | H04R 25/656 181/135 |
| 8,611,969 | B2 | 12/2013 | Smith et al. | |
| 8,737,669 | B2 | 5/2014 | Monahan et al. | |
| 8,848,964 | B2 * | 9/2014 | Erdel | H04R 1/1091 381/338 |
| 8,873,786 | B2 | 10/2014 | Larsen et al. | |
| 8,897,480 | B2 | 11/2014 | Tan et al. | |
| 8,929,582 | B2 | 1/2015 | Silvestri et al. | |
| 8,989,426 | B2 | 3/2015 | Silvestri et al. | |
| 9,036,852 | B2 | 5/2015 | Silvestri et al. | |
| 9,036,853 | B2 | 5/2015 | Silvestri et al. | |
| 9,042,590 | B2 | 5/2015 | Silvestri et al. | |
| 9,357,319 | B2 * | 5/2016 | Yoon | H04R 1/1041 |
| 9,398,364 | B2 * | 7/2016 | Monahan | H04R 1/1016 |
| 9,462,366 | B2 | 10/2016 | Silvestri et al. | |
| 9,807,524 | B2 * | 10/2017 | Shennib | H04R 25/652 |
| 9,955,249 | B2 | 4/2018 | Searl et al. | |
| 10,009,680 | B2 * | 6/2018 | Briggs | H04R 1/1058 |
| 10,034,078 | B2 | 7/2018 | Silvestri et al. | |
| 10,045,113 | B2 | 8/2018 | Silvestri et al. | |
| 10,291,980 | B2 | 5/2019 | Silvestri et al. | |
| 10,334,344 | B2 | 6/2019 | Monahan et al. | |
| 10,652,644 | B2 * | 5/2020 | Bruss | H04R 1/1016 |
| 2003/0174853 | A1 | 9/2003 | Howes et al. | |
| 2011/0058704 | A1 | 3/2011 | Harlow et al. | |
| 2011/0268308 | A1 * | 11/2011 | Vasquez | H04R 1/1016 381/380 |
| 2012/0243726 | A1 * | 9/2012 | Hosoo | H04R 1/1016 381/380 |
| 2013/0163803 | A1 | 6/2013 | Erdel | |
| 2016/0261942 | A1 | 9/2016 | Hayden | |
| 2017/0164093 | A1 | 6/2017 | Silvestri et al. | |
| 2018/0184187 | A1 | 6/2018 | Silvestri et al. | |
| 2018/0242068 | A1 | 8/2018 | Kelley et al. | |
| 2019/0007761 | A1 * | 1/2019 | Higgins | H04R 25/60 |
| 2019/0007762 | A1 | 1/2019 | Paetsch et al. | |
| 2019/0166438 | A1 * | 5/2019 | Perkins | H04R 1/1041 |
| 2019/0238976 | A1 | 8/2019 | Silvestri et al. | |
| 2019/0253782 | A1 | 8/2019 | Monahan et al. | |
| 2020/0014995 | A1 | 1/2020 | Monahan et al. | |

* cited by examiner

EAR TIP SEALING STRUCTURE

CROSS-REFERENCE TO RELATED APPLICATIONS

This application is a continuation-in-part of co-pending U.S. patent application Ser. No. 16/241,045, titled "EAR TIP SEALING STRUCTURE," filed Jan. 7, 2019. The aforementioned related patent application is herein incorporated by reference in its entirety.

BACKGROUND

Aspects of the present disclosure describe various features of an in-ear tip including a structure for positioning and retaining the ear tip and a structure for sealing the ear tip against the entrance to the ear canal.

SUMMARY

Aspects describe an in-ear ear tip that is comfortable to position and wear while providing a seal between the ear tip and the wearer's ear canal. As described herein, the body of the ear tip is shaped to fit in the wearer's lower concha. The nozzle of the ear tip is angled upwards from a horizontal centerline of the ear tip body, towards the ear canal of the wearer. This helps to position an optional feedback microphone closer to the ear canal. According to aspects, the stiffness of the material in portions of the body, sealing structure, and positioning structure are selected to provide structural support for an earbud housed in the ear tip and while being comfortable for the wearer.

Aspects provide an ear tip for an in-ear earpiece. The ear tip comprises a body shaped to fit in the lower concha of a wearer's ear, a nozzle extending towards the ear canal of the wearer's ear and comprising a distal end, the nozzle including an acoustic passage to conduct sound waves to the ear canal of the wearer, wherein at least a portion of the distal end of the nozzle comprises a non-planar surface, and a sealing structure extending from the non-planar surface of the nozzle.

In an aspect, the non-planar surface is closer to the ear canal of the wearer than the body of the ear tip when the ear tip is positioned in the wearer's ear.

In an aspect, the non-planar surface comprises a series of peaks and valleys.

In an aspect, the non-planar surface comprises a series of plateaus and valleys.

In an aspect, the non-planar surface of the distal end has an elliptical shape, wherein the major axis of the elliptical shape is substantially aligned with the major axis of the wearer's ear canal when the ear tip is positioned in the wearer's ear. One or more holes are recessed from the non-planar surface of the distal end, the one or more holes being disposed on the major axis of the elliptical shape. The non-planar surface comprises a series of plateaus and valleys, and wherein one or more first valleys disposed on the major axis of the elliptical shape have a greater depth than one or more second valleys offset from the major axis of the elliptical shape. The non-planar surface comprises one or more notches disposed on the major axis of the elliptical shape, the one or more notches extending from an outer surface of the sealing structure to an inner surface of the nozzle.

In an aspect, the non-planar surface has a sinusoidal shape.

In an aspect, the non-planar surface comprises one or more valleys, the one or more valleys each coupled to a channel extending partially down an outer surface of the sealing structure from the non-planar surface, wherein the channels have a shape that tapers off prior to reaching a surface of the sealing structure opposite the non-planar surface.

In an aspect, the ear tip further comprises a curved retaining structure extending from the body, the retaining structure applying pressure to at least a portion of the antihelix of the wearer's ear when the ear tip is positioned in the wearer's ear, wherein the retaining structure comprises a leg that tapers in thickness from the body to the tip.

In an aspect, the sealing structure has a substantially frusto conical shape. A narrow end of the sealing structure is joined to the nozzle and a wide end of the sealing structure is larger than a typical ear canal is wide.

Aspects provide an ear tip for an in-ear earpiece. The ear tip comprises a body shaped to fit in the lower concha of a wearer's ear, a nozzle extending towards the ear canal of the wearer's ear and comprising a distal end, the nozzle including an acoustic passage to conduct sound waves to the ear canal of the wearer, wherein at least a portion of the distal end of the nozzle comprises a first surface disposed closer to the ear canal of the wearer than the body of the ear tip when the ear tip is positioned in the wearer's ear, and wherein the first surface comprises one or more valleys or notches, and a sealing structure extending from the first surface of the nozzle.

In an aspect, the first surface comprises a series of peaks and valleys having a sinusoidal shape.

In an aspect, the first surface comprises a series of plateaus and valleys.

In an aspect, the first surface of the distal end has an elliptical shape, wherein the major axis of the elliptical shape is substantially aligned with a major axis of the wearer's ear canal when the ear tip is positioned in the wearer's ear. One or more holes are recessed from the first surface of the distal end, the one or more holes being disposed on the major axis of the elliptical shape, and wherein the one or more holes extend through the nozzle and the sealing structure. The first surface comprises a series of plateaus and valleys, and wherein one or more first valleys disposed on the major axis of the elliptical shape have a greater depth than one or more second valleys offset from the major axis of the elliptical shape. The first surface comprises one or more notches disposed on the major axis of the elliptical shape, the one or more notches extending from an outer surface of the sealing structure to an inner surface of the nozzle.

In an aspect, the first surface comprises one or more valleys, the one or more valleys each coupled to a channel extending partially down an outer surface of the sealing structure from the first surface, wherein the channels have a shape that tapers off prior to reaching a first surface of the sealing structure opposite the first surface of the distal end.

In an aspect, the ear tip further comprises a curved retaining structure extending from the body, the retaining structure applying pressure to at least a portion of the antihelix of the wearer's ear when the ear tip is positioned in the wearer's ear, wherein the retaining structure comprises a leg that tapers in thickness from the body to the tip.

In an aspect, the sealing structure has a substantially frusto conical shape. A narrow end of the sealing structure is joined to the nozzle and a wide end of the sealing structure is larger than a typical ear canal is wide.

All examples and features mentioned herein can be combined in any technically possible manner.

Other features, objects, and advantages will become apparent from the following detailed description, when read in connection with the following drawing.

DETAILED DESCRIPTION

The ear tip described herein provides orientation, stability, and sealing to the entrance of the ear canal and to the ear structure outside the ear canal, without excessive radial pressure, and without inward clamping pressure provided by a source not included in the earpiece. Aspects describe an in-ear earpiece that is designed to fit in the right ear. An earpiece includes an ear tip. An ear tip may be referred to as a cushion that houses an earbud. An earpiece that is designed to fit in the left ear is a mirror image of the earpiece described below, and operates according to the same principles, and is not described herein.

Figure 1A:
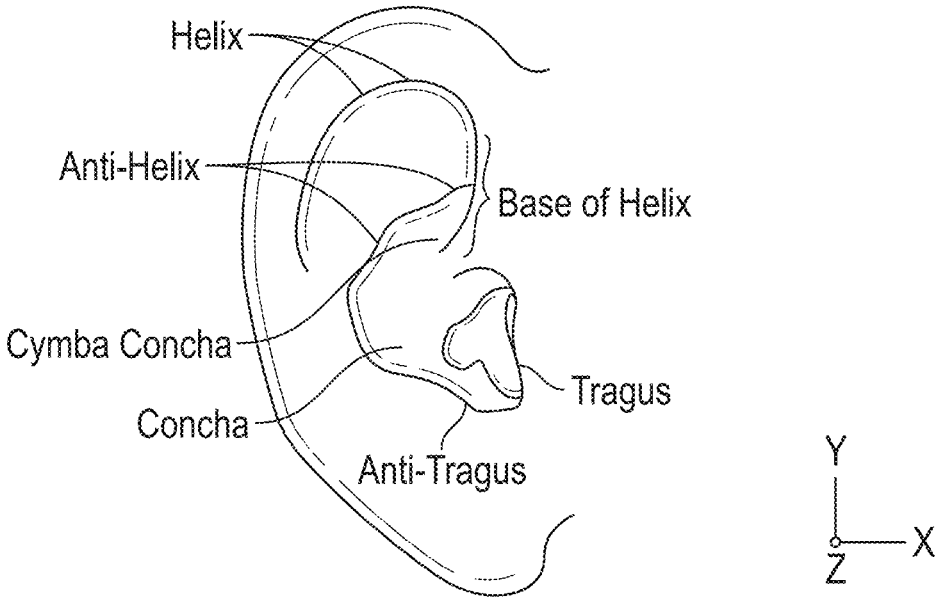
FIG. 1A is a view of the lateral surface of the human ear.
Figure 1B:
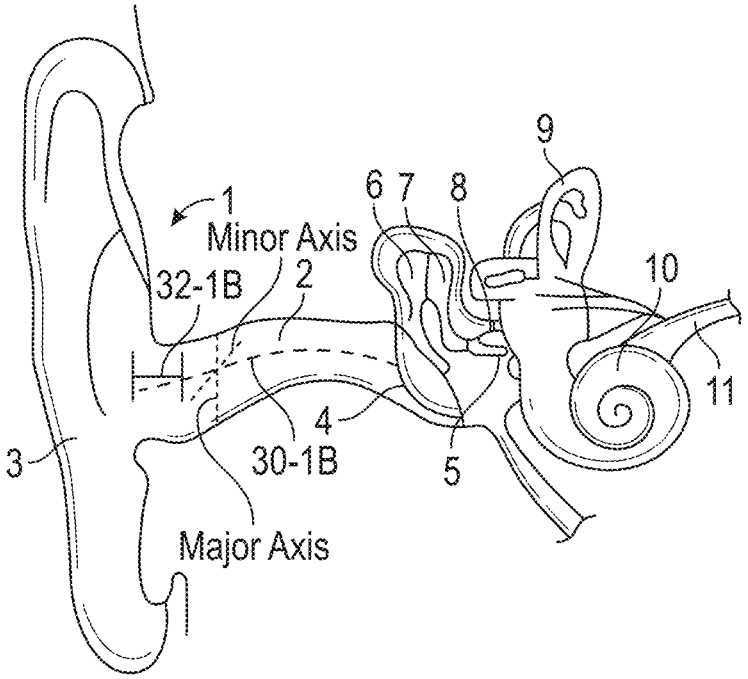
FIGS. 1B and 1C are exemplary cross-sections of the human ear.
Figure 1C:
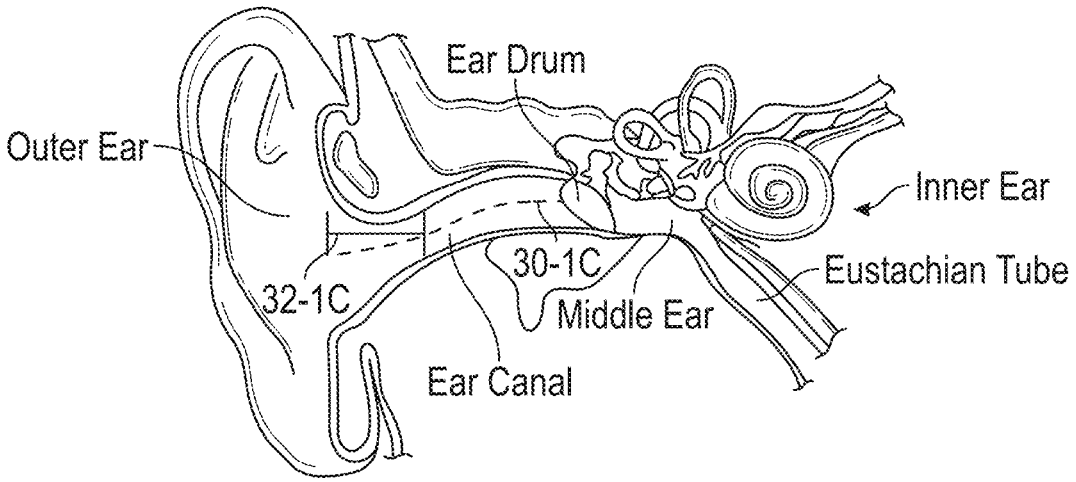

FIG. 1A shows the lateral surface of a human right ear, with some features identified. There are many different ear sizes and geometries. Some ears have additional features that are not shown in FIG. 1A. Some ears lack some of the features that are shown in FIG. 1A. Some features may be more or less prominent than are shown in FIG. 1A. FIGS. 1B and 1C show two exemplary cross-sections of the human ear, with some features identified. The ear canal is an irregularly shaped cylinder with a variable cross sectional area and a centerline that is not straight. Among the features identified is the entrance to the ear canal and the main portion of the ear canal. In this specification, the entrance to the ear canal refers to the portion of the ear canal near the concha where the walls of the ear canal are substantially non-parallel to the centerline of the ear canal. The precise structure of the human ear varies widely from individual to individual. For example, in the cross section of FIG. 1B, there is a relatively sharp transition from ear canal walls that are non-parallel to a centerline 30-1B of the ear canal to walls that are substantially parallel to a centerline of the ear canal, so the entrance 32-1B to the ear canal is relatively short. In the cross-section of FIG. 1C, there is a more gradual transition from walls that are non-parallel to a centerline of the ear canal to walls that are substantially parallel to a centerline 30-1C of the ear canal, so the entrance 32-1C to the ear canal is relatively long.

Figure 2A:
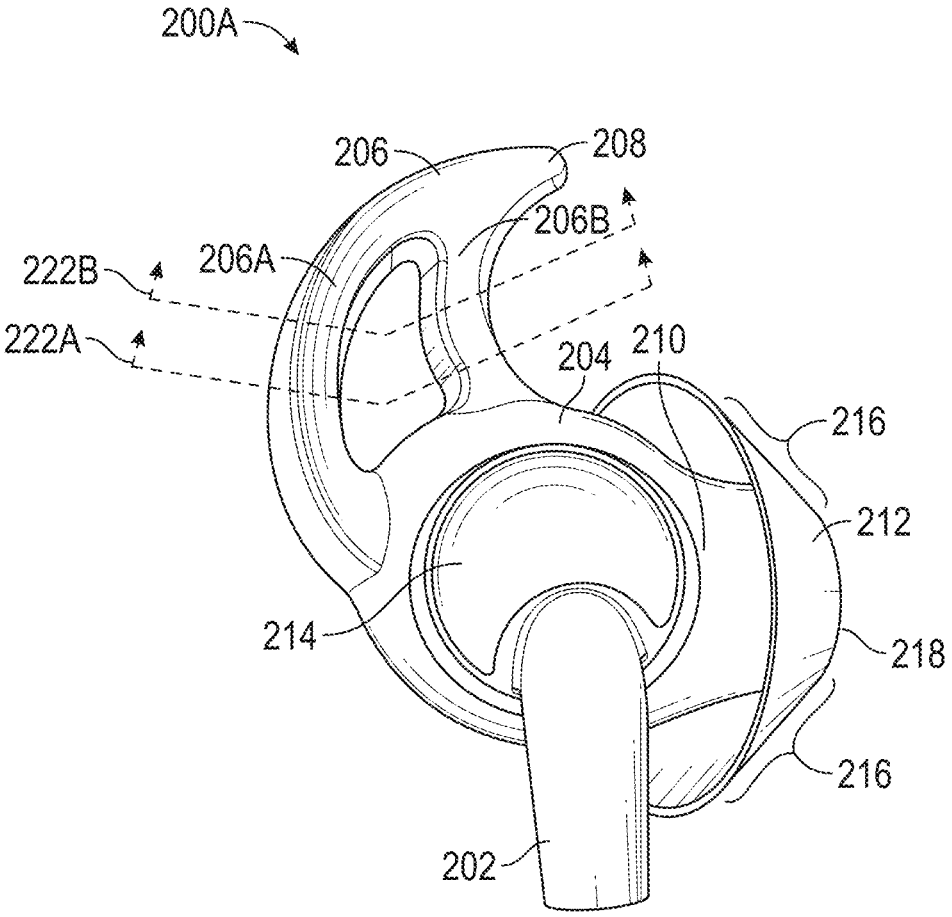
FIG. 2A is a front view of an ear tip including an earbud.

FIG. 2A is a front view of an earpiece 200A. The earpiece includes an ear tip or cushion that houses an earbud. In examples, the ear tip includes three portions: a body 204, a substantially frusto-conical sealing structure 212, and a positioning and retaining structure 206. The earpiece 200A may optionally include a stem 202 for positioning cabling and the like, a body 204 that houses an acoustic driver module, a nozzle 210 extending from the body 204 towards a substantially frusto-conical sealing structure 212, and a positioning and retaining structure 206. Some earpieces may lack the stem 202 but may include electronics modules (not shown) for wirelessly communicating with external devices. Other earpieces may lack the stem and the acoustic driver module and may function as passive earplugs.

Figure 2B:
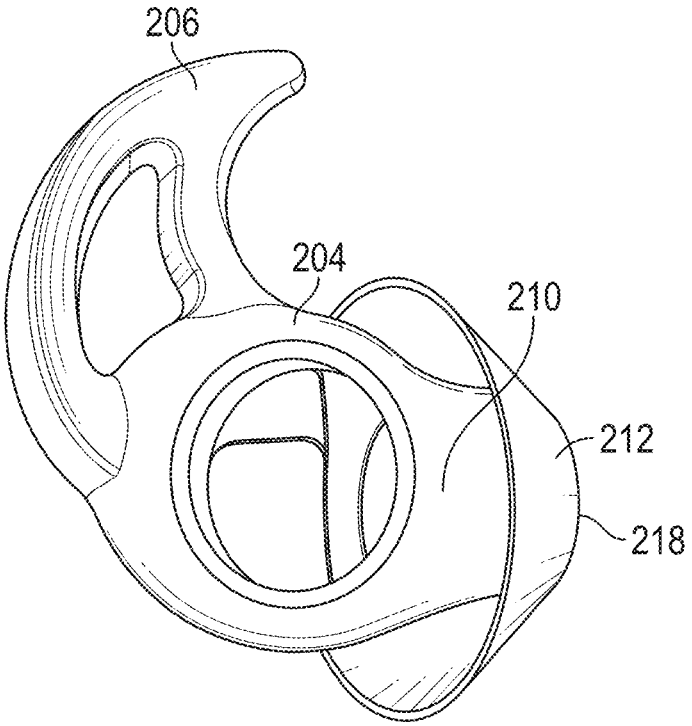
FIG. 2B is a rear view of an ear tip.
Figure 2C:
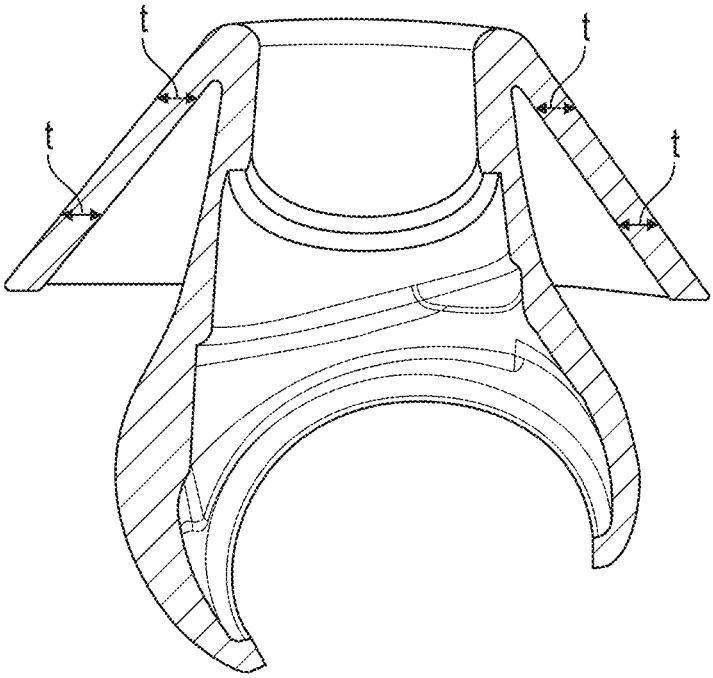
FIG. 2C illustrates an example cross-section of an ear tip.
Figure 2D:
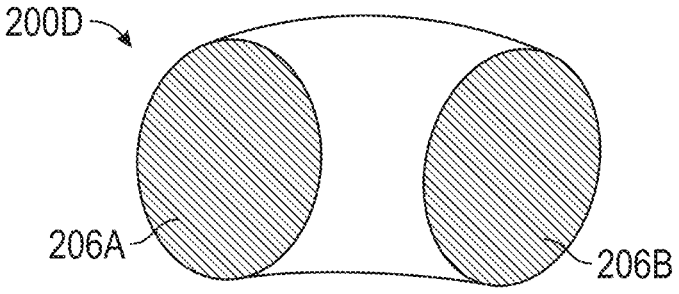
FIG. 2D illustrates an example cross-section of a positioning and retaining structure.
Figure 3:
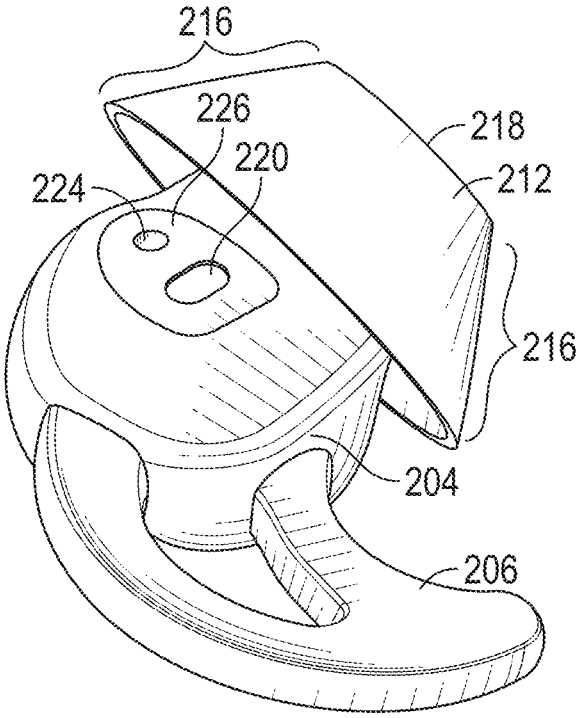
FIG. 3 is a rear view of an ear tip including a sensor lens and a pressure equalization (PEQ) port.
Figure 4:
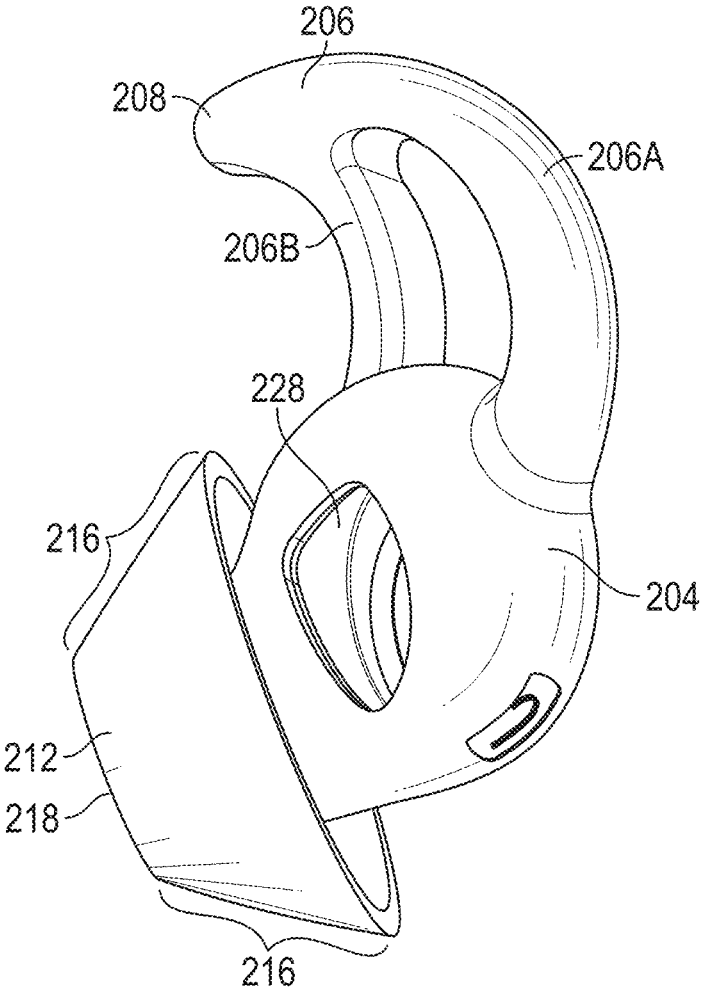
FIG. 4 is a rear view of an earpiece including an opening for a component that includes the sensor lens and PEQ port.
Figure 5A:
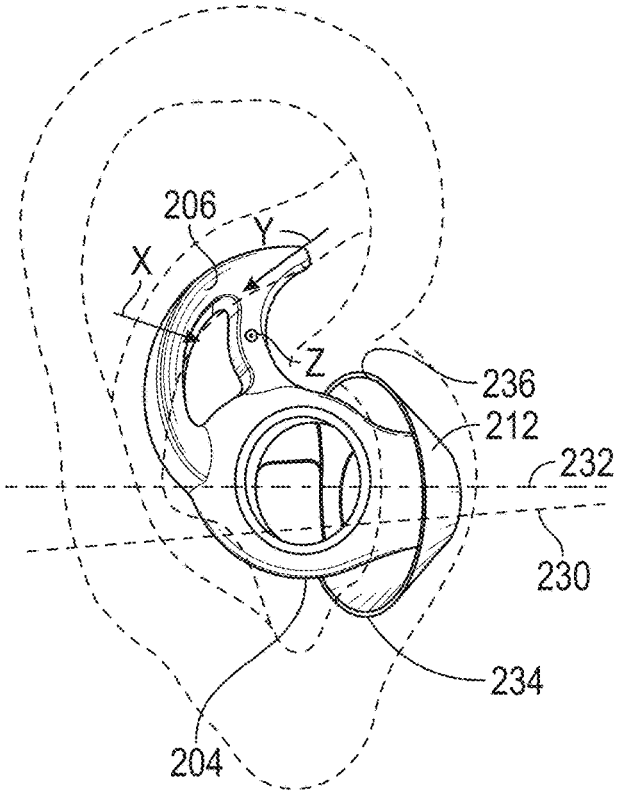
FIG. 5A is an example of an ear tip positioned in a wearer's ear.
Figure 5B:
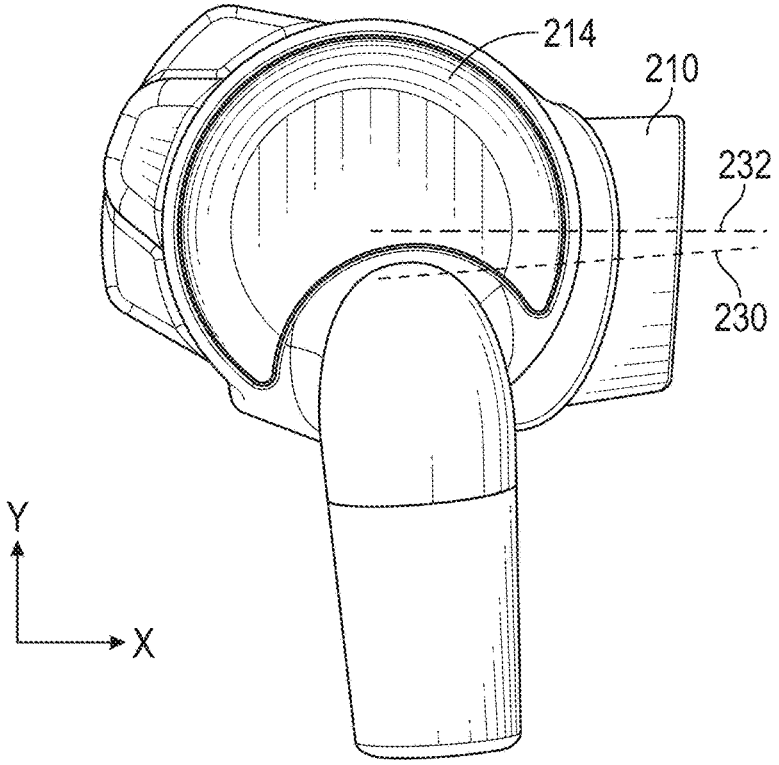
FIG. 5B illustrates an example of a portion of an earbud and nozzle that is not positioned in a wearer's ear.
Figure 5C:
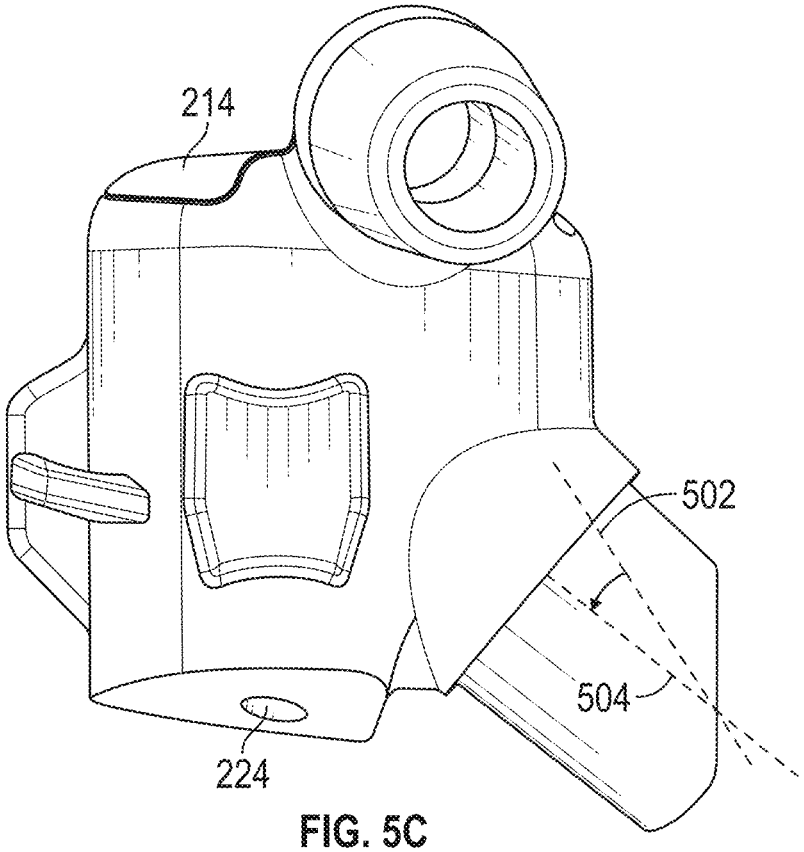
FIG. 5C illustrates a side view of a portion of an earbud and nozzle outside of the wearer's ear.
Figure 5D:
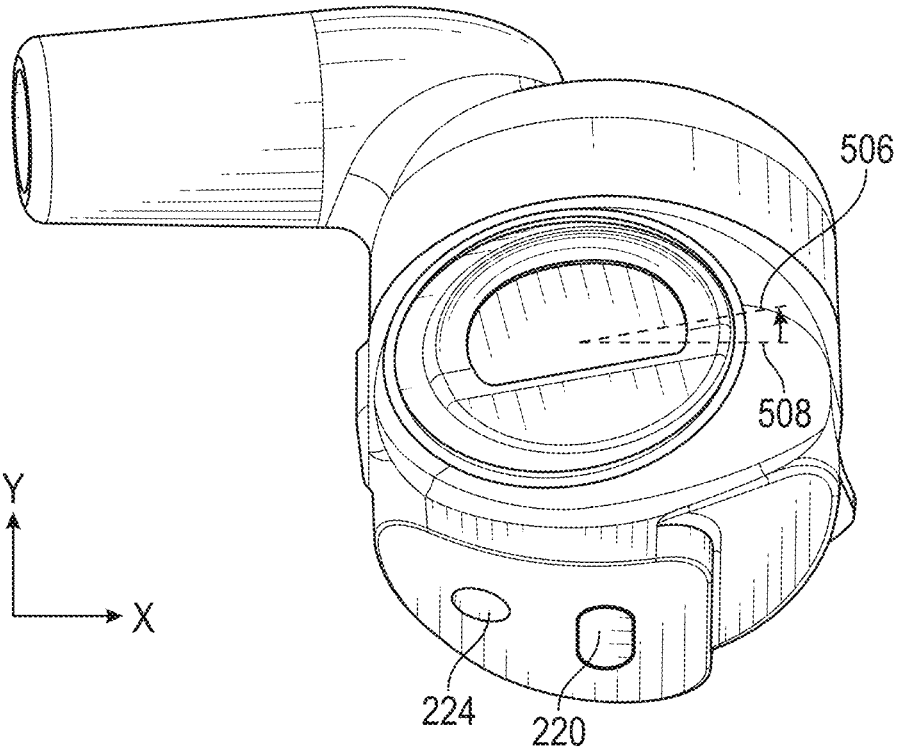
FIG. 5D illustrates an example of portions of an earpiece.
Figure 6:
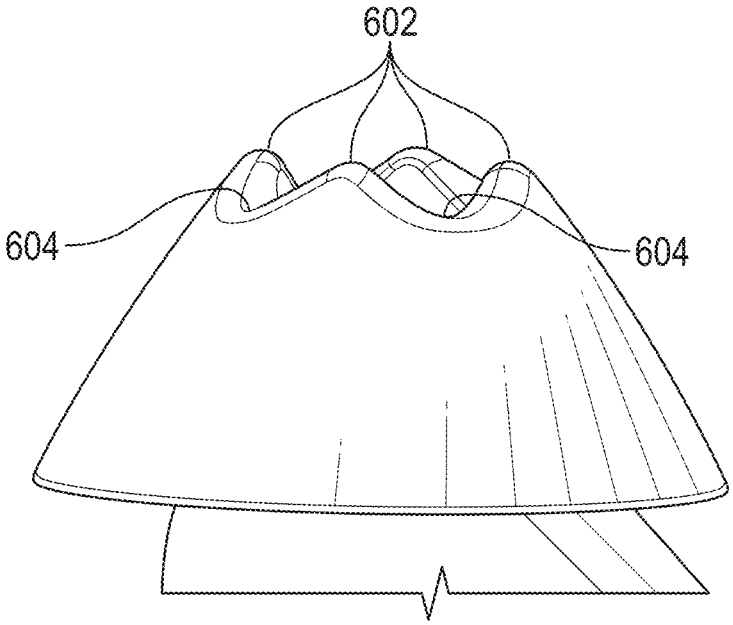
FIG. 6 is a side view of a nozzle having a non-planar distal end.
Figure 7:
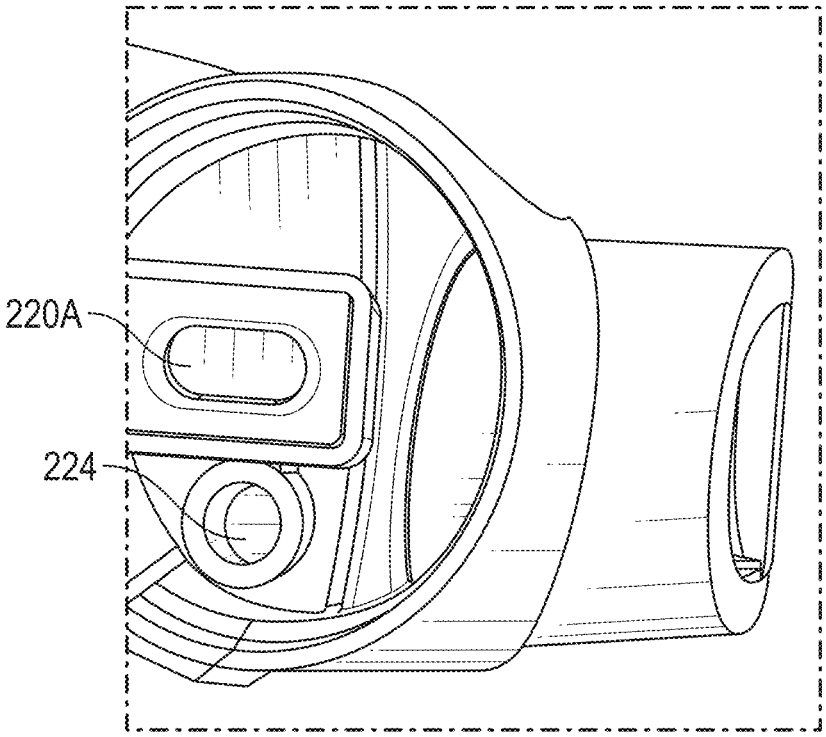
FIG. 7 illustrates a rear chamber of an earbud.
Figure 8:
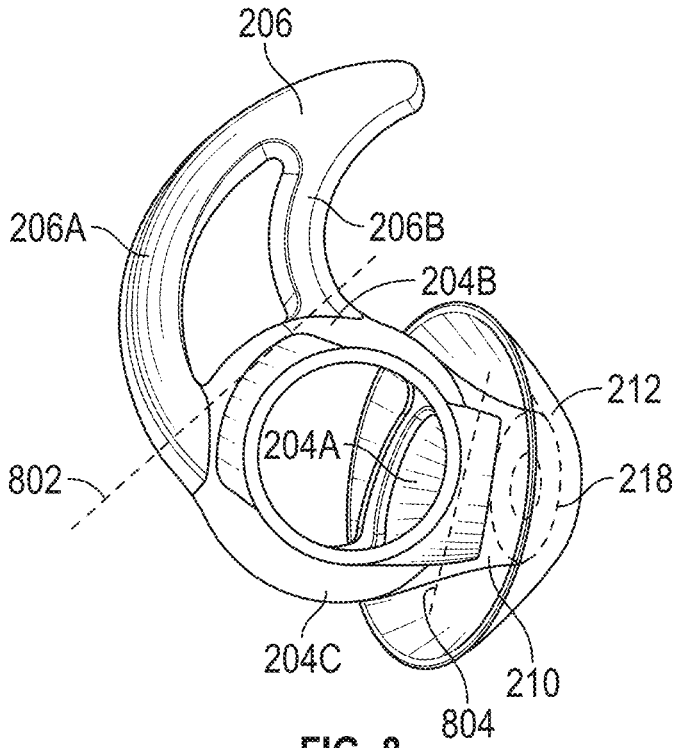
FIG. 8 illustrates an example of an ear tip made of a triple durometer material.
Figure 9A:
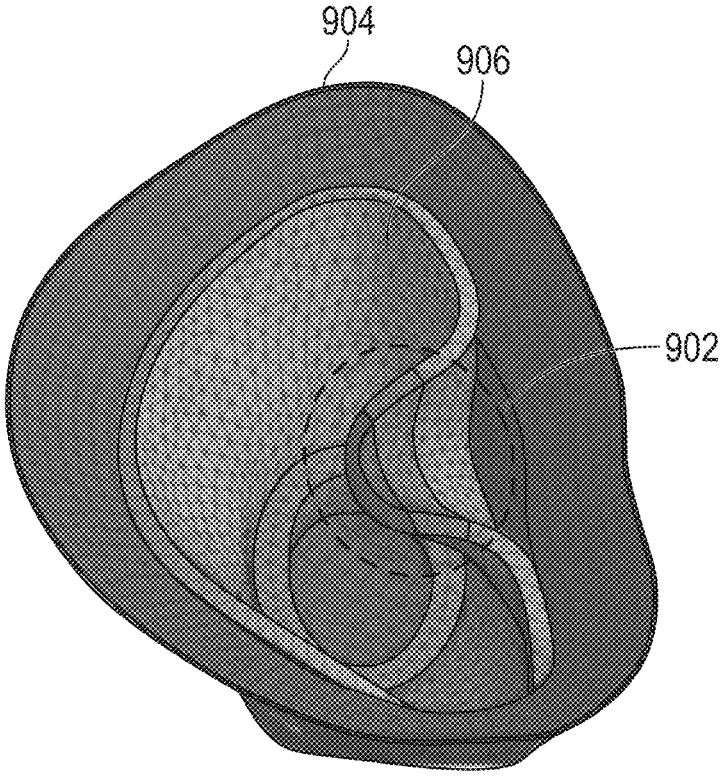
FIG. 9A illustrates an image of an example of buckling in an ear tip having a tapered sealing structure.
Figure 9B:
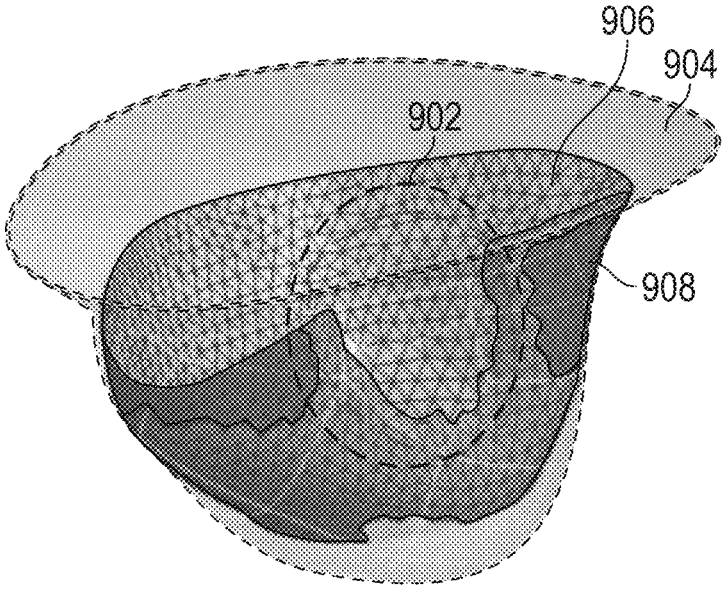
FIG. 9B illustrates an image of an example of how buckling affects the seal between the ear tip and the wearer's ear.
Figure 10:
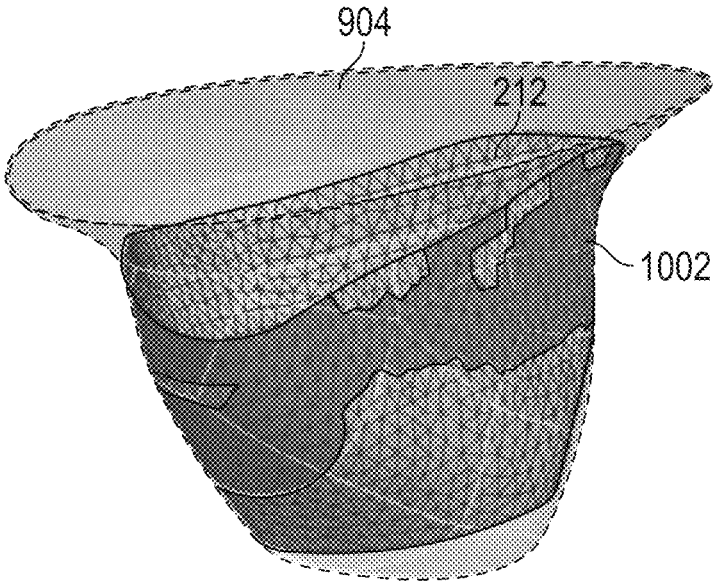
FIG. 10 illustrates an image of an example of a seal between the circumference of the ear tip and the wearer's ear.

FIG. 2B illustrates a front view of an earpiece without an earbud 214. FIG. 2C illustrates an example cross-section of an ear tip. FIG. 2D illustrates an example cross-section of an example positioning and retaining structure. FIG. 3 is a rear view of an earpiece, including a sensor lens 220 and PEQ port 224, and not including an earbud 214 and stem 202. FIG. 4 is a rear view of an earpiece not including the earbud 214, stem 202, and sensor lens 220. FIG. 5A illustrates an example ear tip positioned in a wearer's ear. FIG. 5B illustrates an example of a portion of an earbud and nozzle outside of a wearer's ear. FIG. 5C illustrates a side view of a portion of an earbud and nozzle outside of the wearer's ear. FIG. 5D illustrates an example of portions of an earpiece. FIG. 6 illustrates an example of a nozzle having a non-planar distal end. FIG. 7 illustrates an example of a portion of a rear chamber of an earbud. FIG. 8 illustrates an example of a triple durometer ear tip that does not include an earbud. FIG. 9A illustrates an example of buckling in an ear tip having a tapered sealing structure. FIG. 9B illustrates an example of how buckling affects the seal between the ear tip and the wearer's ear. FIG. 10 illustrates an example of a seal formed between the circumference of the ear tip and the wearer's ear canal when the ear tip has a substantially constant thickness from the nozzle extending down the tip. Some elements may not be marked or visible in every figure. For sake of consistency, similar reference numerals are used throughout FIGS. 2A-10. The features illustrated in FIGS. 2A-10 may be combined in a single earpiece in any technically feasible manner.

The earpiece 200A may include a stem 202 for positioning cabling and the like, a body 204 that houses an acoustic driver module, a nozzle 210 extending from the body 204 towards a substantially frusto-conical sealing structure 212, and a positioning and retaining structure.

The body 204 of the ear tip is substantially elliptical in shape. A substantially elliptical shape is suited to align with typical ear geometries. The shape of the body 204 is configured to match the lower concha of a wearer's ear as illustrated in FIG. 5A.

In an example, the body 204 houses an earbud 214 including an acoustic driver module. The earbud 214 may include a stem 202 for positioning cabling and the like; however, some earbuds, and therefore earpieces, may lack the stem 202 and may include electronic modules (not shown) for wirelessly communicating with external devices. Other earpieces may lack the stem and the acoustic driver module and may function as passive earplugs.

In an example, one or more snaps or protrusions are formed on an external portion of an earbud housing. In an aspect, the snaps are referred to as retention ribs. The body 204 stretches around the earbud housing. The body has mating features that correspond to the snaps. The snaps or protrusions help to hold the body 204 around the earbud. In addition, the snaps and mating features help prevent the earbud from falling from the body without intention. In an example, a first snap extends long a first portion of the earbud housing and a second snap extends around a second portion of the earbud housing. The snaps help to hold the stretched body in place, around the housing. In an example, an interior surface of the body has indentations configured to receive the snaps to further help the body stay positioned over the earbud housing.

A nozzle 210 extends from the body 204 towards the ear canal of the wearer's ear. The nozzle includes an acoustic passage to conduct sound waves to the ear canal of the wearer. FIG. 5A illustrates an ear tip positioned in a wearer's ear. FIG. 5B illustrates a portion of an earbud and nozzle outside of the wearer's ear. As illustrated in FIG. 5B, the horizontal centerline 230 of the nozzle is offset from the horizontal centerline of the body 232. By angling the nozzle upward from the horizontal centerline of the body 232, the nozzle is tilted to align with typical ear geometry. According to aspects, the horizontal centerline of the nozzle 230 is offset from the horizontal centerline of the body 232 by approximately 5 degrees. According to aspects, the nozzle houses a feedback microphone, which may be used to perform feedback active noise reduction (ANR). The tilt of the nozzle, relative to the body, positions the feedback microphone closer to the eardrum.

FIG. 5C illustrates a side view of a portion of an earbud and nozzle outside of the wearer's ear. In some earpieces, the nozzle is angled from the earbud along a nozzle centerline 502. According to aspects, in the earpiece described herein, the nozzle 210 is angled downward as shown along the nozzle centerline 504, so the earpiece sits more deeply into the concha of the wearer's ear than it would where the nozzle angled along the nozzle centerline 502. In aspects, the nozzle is angled downward having a centerline as shown at 504 in combination with the nozzle being offset from the horizontal centerline of the body, as shown in FIGS. 5A and 5B.

FIG. 5D illustrates an example of portions of an earpiece. According to aspects, in addition to the horizontal centerline 230 of the nozzle being offset from the horizontal centerline of the body (as shown in FIGS. 5A and 5B) and the nozzle being angled as shown in FIG. 5C, an elliptical opening for the nozzle is not parallel with the X-axis as shown at 506. This results in slight rotation of the sealing structure 212 to create a good seal with a typical wearer's ear canal.

In an example, a distal end of the nozzle 210 includes a planar surface 218. A planar surface at the distal end of the nozzle is illustrated, for example, in FIGS. 2A and 8. In other examples, and as shown in FIG. 6, at least a portion of the distal end of the nozzle includes a non-planar surface. In certain scenarios, it is undesirable for the distal end of the nozzle to be sealed off or substantially sealed off from air flow. As an example, under certain conditions when an ear tip is placed in the wearer's ear, the distal end of the nozzle may become substantially sealed because it contacts the wearer's ear canal as the wearer is positioning the ear tip in the wearer's ear. In an earbud that provides active noise cancellation, acoustic circuitry (housed in the earbud, for example) may output a signal to offset the sounds received from a feedback microphone. When the end of the nozzle becomes blocked, or substantially sealed, as it may during positioning of the earbud in the wearer's ear, an undesirable high-pitched noise or squeal may be outputted, which creates an undesirable experience for the wearer. According to an example, a non-planar surface includes at a series of peaks 602 and a series of valleys 604 around the distal end of the nozzle. The peaks 602 may each extend to a same or substantially similar height from the end of the nozzle. The valleys 604 may have a same or substantially similar height relative to the peaks 602. A non-planar design, such as the example illustrated in FIG. 6, make it more unlikely that the end of the nozzle may be sealed off or substantially sealed off from air flow, e.g., during positioning of the earbud in the wearer's ear.

A narrow end of the substantially frusto-conical sealing structure 212 occurs at a distal end of the nozzle 210. The wider end of the frusto-conical sealing structure 212 is larger than a typical ear canal is wide. The frusto-conical sealing structure 212 has a straight or substantially straight edge on an interior portion proximate to the nozzle 210. In aspects, the frusto-conical sealing structure 212 has a curvature on an exterior portion 216 of the sealing structure 212. In an example, the curvature is approximately a 40 mm radius. The exterior portion 216 of the sealing structure 212 contacts the flesh of the wearer's ear when the ear tip is positioned in the wearer's ear.

FIG. 2C illustrates a cross-section of an ear tip, in accordance with certain aspects. As illustrated in FIG. 2C, in aspects, the frusto-conical sealing structure 212 has a substantially constant thickness t from the nozzle extending outwards, when the ear tip is positioned in a wearer's ear. In aspects, the constant or substantially constant thickness t is approximately 1.1 mm. A sealing structure having a constant or substantially constant thickness provides consistency in sealing from user to user.

Some sealing structures taper in thickness from the nozzle extending outwards when the ear tip is positioned in a wearer's ear. For some users, this tapering leads to buckling or part of the sealing structure folding over itself. FIG. 9A illustrates an example of a tapered sealing structure 906 in an ear canal 904 of a wearer. The sealing structure 906 experiences compressions from the user's ear 904 when positioned in-ear. As a result, the sealing structure 906 buckles, as shown at 902, when positioned in the ear 904.

The buckling does not allow a seal to form between the circumference of the sealing structure 906 and the ear canal. In FIG. 9B, the sealing structure 906 is positioned in the wearer's ear 904. 908 illustrates portions of the sealing structure 906 that may contact and create a seal with the wearer's ear 904. As shown in FIG. 9B, a seal is not formed around the circumference of the sealing structure. The lack of seal creates a leak path of the sealing structure where the sealing structure folds over itself at 902.

The leak path negatively affects the user's perception of ANR performed by the earpiece. In an example earpiece that performs ANR, the speaker plays a sound that travels through both the nozzle and the leak path. The desired sound traveling through the leak path is fed to a feedforward microphone, and an unwanted feedback loop is created around the sound that traveled from the speaker to the leak path. This is especially undesirable for hearing assistance headphones. In certain scenarios, the leak path results in poor bass performance.

Unlike some tapered sealing structure designs, where the sealing structure tapers in thickness from the nozzle extending outwards, a sealing structure having a constant thickness creates a better seal with the ear canal of a wearer's ear. FIG. 10 illustrates an untapered sealing structure 212 positioned in a wearer's ear 904. 1002 illustrates portions of the sealing structure 212 that contact and create a seal with the wearer's ear 904. A seal formed around the circumference of the sealing structure 212 with the wearer's ear 904 improves ANR performance by canceling out undesired noises, improves bass performance, and provides increased consistency in sealing from user to user. The frusto-conical sealing structure 212 is asymmetric. Referring to FIG. 5A, when positioned in a wearer's ear, the angle between the centerline of the nozzle 230 to the lowest 234, bottom portion of the frusto-conical sealing structure 212 is larger than the angle between the centerline of the nozzle 230 to the highest 236, top portion of the frusto-conical sealing structure 212. The larger angle allows more surface area on the bottom part of the frusto-conical sealing structure 212 to create a better seal along the anti-tragus of a wearer's ear.

The length of the frusto-conical sealing structure 212 between the highest point 236 and lowest point 234 ranges between approximately 17 mm to approximately 21 mm. A sealing structure within these dimensions fits into the ear canal of many users to comfortably enter and seal the entrance of the ear canal. Smaller or larger versions may be used for users with below- or above-averaged-sized ear, including children. Versions with similar overall size but different aspect ratios may be provided for users with ear canal entrances that are more- or less-circular than average.

The positioning and retaining structure 206 holds the earpiece in position in a wearer's ear, without significant contribution from the portions of the ear tip that engage the ear canal and without any structure external to the ear tip.

In an example, the ear tip includes a positioning and retaining structure 206 having an outer leg 206A and an inner leg 206B. A first end of the outer leg 206A is attached to a first end of the inner leg 206B and form a point 208. A second end of the outer leg 206A and a second end of the inner leg 206B are separately attached to the body 204. The outer leg 206A is curved to generally follow the curve of the anti-helix and/or the cymba concha at the rear of the concha. In other examples, more than two legs or only a single leg may be used.

The outer leg 206A and the inner leg 206B have substantially equal lengths and are elliptical in shape. The outer leg 206A and the inner leg 206B taper in thickness from the body 204 to the tip 208. Therefore, as shown in FIG. 2A, a cross-section at 222A would result in larger, substantially elliptical shapes than a cross-section at 222B. FIG. 2D illustrates an example cross-section off the elliptical shapes 200D of the outer leg 206A and inner leg 206B.

The increased thickness of the legs 206A, 206B closer to the body 204 provides increased stiffness and stability of the positioning and retaining structure 206 closer to the body 204. The stability of the positioning and retaining structure is increased in at least two ways. First, tapered legs of the positioning and retaining structure help to stiffen the legs and make it more difficult to flex the legs into and out of the page (Z direction), when the ear tip is viewed from the front of back (e.g., FIG. 2A and FIG. 4). Additionally, tapered legs make it more difficult to press the legs towards each other and rotate away from the anti-helix in the opposite direction of the Y vector. These two motions are typically used to remove an ear tip from the wearer's ear. In an example, the X vector represents the constant force felt when the ear tip is inserted in a wearer's ear. Therefore, in aspects, stiffness is increased in the Z direction and along the Y vector and not as much along the X vector. According to aspects, and as shown in FIG. 2D, to achieve a higher stiffness in the Y and Z directions, the cross-section of each of the legs 206A and 206B are substantially elliptical in shape. A substantially elliptical shape as opposed to other shapes, such as a blended rectangle, creates a lean, simple design that allows more stiffness along the major axis of the ellipse with little or no change to the minor axis. According to aspects, a tapered outer leg 206A also helps to stiffen the positioning and retaining structure 206 in the Y and Z directions with minimal impact to the wearer's comfort along the X direction. In examples where there are more or fewer legs, each leg presented tapers in thickness from the body 204 to the tip 208 as described herein.

Aspects describe and illustrate a positioning and retaining structure having two legs; however, the disclosure is not limited to an ear tip having two legs. In an example, an ear tip includes a single leg extending from the body and configured to follow the curve of the anti-helix and/or the cymba concha at the rear of the concha. The single leg tapers in thickness from the body to the tip.

Generally, the substantially frusto-conical sealing structure 212 is placed in the wearer's ear and pushed gently inward and preferably rotated counter-clockwise. Pushing the body into the ear causes the outer leg 206A to seat in position underneath the anti-helix, and causes the narrow end of the sealing structure 212 to enter the ear canal by a small amount, depending on the dimensions and geometry of the entrance to the ear canal. The body 204 is then rotated clockwise until the body cannot be further rotated. One example of steps for placing an earpiece or ear tip in a wearer's ear are described in U.S. Pat. No. 8,737,669, entitled "Earpiece passive noise attenuating," which is incorporated by reference herein in its entirety.

According to aspects, the body 204 provides access to internal housing of the earbud. As illustrated in FIG. 3, in an example, a component 226 (which may be a housing of the earbud) includes a sensor lens 220 and an opening for a pressure equalization (PEQ) port 224, which vents from the front cavity of the acoustic driver to an environment external to the earbud. The sensor lens may be an infrared (IR) sensor. The IR sensor may be used to collect biologically relevant information of a user wearing the earpiece, or to detect whether the earbud is engaged with or near a wearer's ear. The PEQ port may be used, for example, in non-ANR earpieces, to relieve air pressure that could be built up within the ear canal and front cavity of the earbud, e.g., when the earbud is inserted into or removed from the ear, when a person wearing the earbud experiences shock or vibration, or when the earbud is struck or repositioned while being worn. FIG. 7 illustrates an example front chamber of an earbud having an opening 220A for a sensor lens and a PEQ port 224. FIG. 4 illustrates an opening 228 in ear tip for the component 226.

The locations of the sensor lens 220 and port 224 towards the back of the earpiece proximate to the concha, as illustrated in FIGS. 3-5 help to position components of the earpiece towards the wearer's concha to make the earpiece compact and protrude less from the wearer's ear.

FIG. 8 illustrates an ear tip formed using a triple durometer material. In some aspects, the body 204 includes an inner body 204A and an outer body 204B, 204C. The inner body 204A may be referred to as a core. The inner body 204A holds the earbud (not illustrated in FIG. 8) in the ear tip. According to aspects, the outer body 204B, 204C is formed over the inner body 204A. The method of forming the outer body using two materials molded over a first material that forms the inner core is referred to as 2-1 molding, because two different materials are molded over the single material of inner core at a same time. According to aspects, the tolerance of where the two materials, that are formed over the inner core, merge is anywhere between lines 802 and 804. In aspects, the two different materials molded over the inner core have different colors to form a multi-colored ear tip. In an aspect, the sealing structure 212 and the nozzle 210 (shown, for example, in FIG. 1) are formed from a first material. In one example, the sealing structure 212 and the nozzle 210 are formed from the first material and the positioning and retaining structure 206 is formed from a second material. In aspects, the two materials that are molded over the inner core have different colors and different hardness values.

The inner body 204A is formed using a more rigid material relative to the materials of the outer body 204B and 204C. The outer body is formed of material having two different durometers, both of which are more flexible than the material used to form the inner core.

In an example, the inner body 204A is made of a material having a first, hardness. The positioning and retaining structure (including outer leg 206A and inner leg 206B) and a portion of the outer body 204B proximate to the outer and inner legs are made of material having a second hardness. The frusto-conical sealing structure 212 and a portion of the outer body 204C proximate to the sealing structure are made of a material having a third hardness. The second hardness is softer and more flexible than the first hardness, yet harder than the third hardness. Accordingly, the positioning and retaining structure 206 of the outer body 204B are softer than the material of the inner body 204A and the material of the sealing structure 212 and the portion of the outer body 204C are the softest.

In an example, the inner body 204A is formed with a material having a durometer of approximately 70 Shore A, the positioning and retaining structure 206 and portion of the outer body 204B are formed with a material having a durometer of approximately 40 Shore A, and the sealing structure 212 and the portion of the outer body 204C are formed with a material having a durometer of approximately 20 Shore A. While the area of transition between the outer body 204B and the outer body 204C is shown as being approximately in the center of the body, in other examples, the area of transition could be in other locations along the length of the body.

In an example, the inner body 204A is formed with a material having a durometer of approximately 70 Shore A, the positioning and retaining structure 206 is formed with a material having a durometer of approximately 30 Shore A, and the sealing structure 212 is formed with a material having a durometer of approximately 10 Shore A.

Example materials and hardness values are provided for illustrative purposes only. According to aspects, different combination of materials and hardnesses are used for the three sections 204A, 204B, and 204C. In aspects, the three sections are made of made of the same materials and have a same or substantially similar hardness. While one example describes the positioning and retaining structure 206 being harder than the sealing structure 212, in an aspect, the positioning and retaining structure 206 and the sealing structure 212 have a similar or substantially similar hardness. In aspects, the three sections are made of the same material and have different hardness values. In aspects, the three sections are made of at least two materials.

In a non-illustrated example, a material having a first, more rigid durometer is used to form the inner body 204A. A material having a second durometer that is less rigid than the first durometer is used to form the outer body 204B, 204C. A material having a third durometer that is less rigid than the second durometer is used to form the sealing structure. In an aspect, the positioning and retaining structure is formed of a material having the same durometer as the outer body.

A harder inner core makes the ear tip more rigid and provides support for the earbud housing. The positioning and retaining structure being more flexible than the inner core and more rigid than the sealing structure helps increase a wearer's comfort and provides stability for positioning the ear tip in the wearer's ear. The sealing structure formed of the most flexible material provides comfort when interfacing and providing a gentle seal with the ear canal. While examples refer to the ear tip being formed of silicone, in some examples, other materials may be used, such as thermoplastic elastomer (TPE), polycarbonate, or nylon. In aspects, any combination of materials is used such that the inner body is harder than the outer body, retaining structure, and sealing structure.

In an aspect, the earpiece 200A is coated or selected portions of the earpiece are coated. The coating increases comfort and stability when positioned in-ear. In an aspect, the coating provides a smooth exterior finish that limits the amount of lint, dust, or particles that may adhere to the earpiece. The coating makes the earpiece easier to position by a wearer. In one example, the coating helps the earpiece move around slightly and find a stable position while a wearer is inserting the earpiece in-ear. In an example, any external portion of the earpiece is coated. In one specific example, the body 204 and the frusto-conical sealing structure 212 are coated and the positioning and retaining structure 206 is not coated. In another example, the entire exterior surface of the earpiece is coated.

The features illustrated in FIGS. 2A-10 may be combined in any manner that is technically feasible. As an example, the ear tip illustrated in FIG. 2A may include a sealing structure that has a substantially constant thickness as shown in FIG. 2C, a positioning and retaining structure that tapers in thickness from the body towards the tip, and a nozzle having a non-planar distal end.

As discussed above with reference to FIG. 6, in certain scenarios, it is undesirable for the distal end of the nozzle to be sealed off or substantially sealed off from air flow. When the end of the nozzle becomes blocked, or substantially sealed, as it may during positioning of the earbud in the wearer's ear, an undesirable high-pitched noise or squeal may be outputted, which creates a less than ideal experience for the wearer. FIGS. 11-18C describe various example ear tips comprising nozzles having non-planar distal ends or surfaces. The non-planar distal ends or surfaces of the nozzles are disposed closer to the ear canal of the wearer than the body of the ear tip when the ear tip is positioned in the wearer's ear. Each of the ear tips of FIGS. 11-18C may be coupled to a body and a retaining structure, as discussed above.

Figure 11:
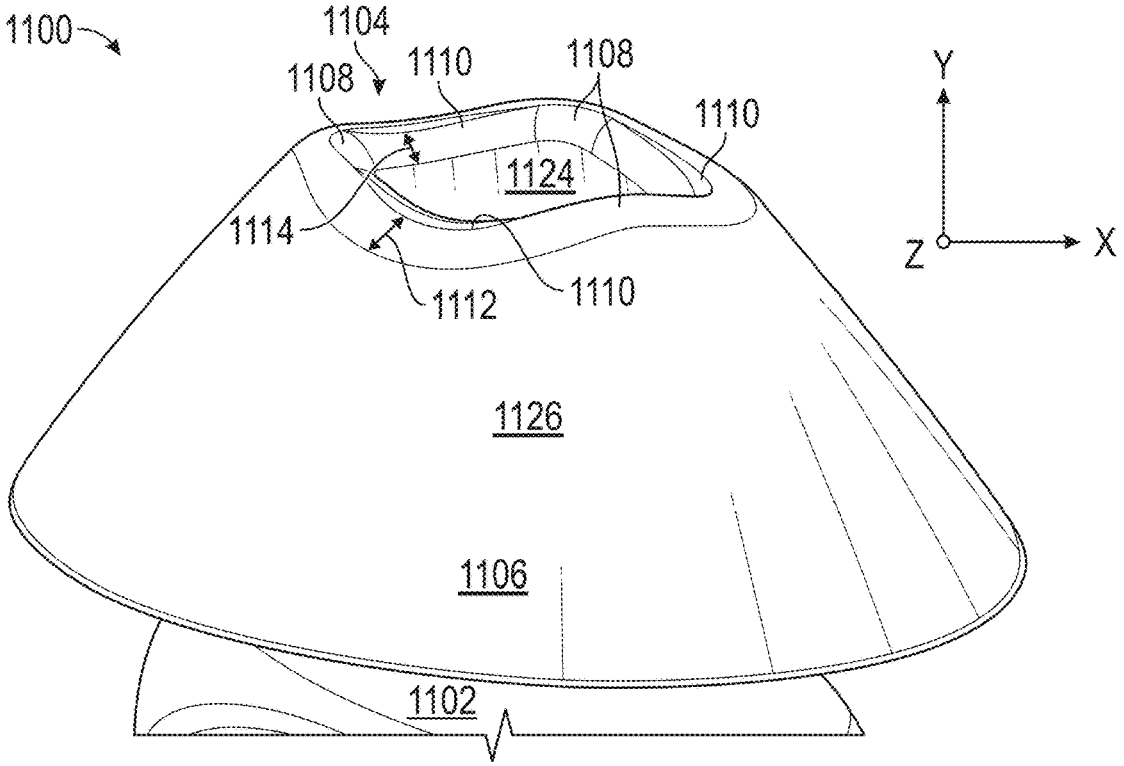
FIG. 11 is a side view of a nozzle having a non-planar distal end, according to an example.

FIG. 11 is a side view of an ear tip 1100 comprising a nozzle 1102 having a non-planar distal surface 1104, according to one example. The nozzle 1102 is coupled to a sealing structure 1106 at the non-planar distal surface 1104. The non-planar distal surface 1104 comprises a series of subtle rolling peaks 1108 and valleys 1110. The peaks 1108 extend in the y-direction while the valleys 1110 extend in the −y-direction, as compared to a conventional planar surface of a nozzle. The peaks 1108 may each extend to a same or substantially similar height in the y-direction from the end of the nozzle 1102, and the valleys 1110 may each extend to a same or substantially similar height in the −y-direction from the end of the nozzle 1102.

The tips of the peaks 1108 are rounded or curved, and do not come to a sharp point. The peaks 1108 and valleys 1110 together give the non-planar distal surface 1104 a sinusoidal shape. An outer surface 1112 of the valleys 1110 of the non-planar distal surface 1104 may be angled towards the sealing structure 1106 in the z-direction. Similarly, an inner surface 1114 of the valleys 1110 of the non-planar distal surface 1104 may be angled towards the nozzle 1102 in the −z-direction. The valleys 1110 extend from an outer surface 1126 of the sealing structure 1106 to an inner surface 1124 of the nozzle 1102.

In FIG. 11, three peaks 1108 and three valleys 1110 are shown. However, the non-planar distal surface 1104 may comprise any suitable number of peaks 1108 and valleys 1110. By including a nozzle 1102 comprising a non-planar distal surface 1104 made up of a series of peaks 1108 and valleys 1110, the non-planar distal surface 1104 of the nozzle 1102 is harder to block when the ear tip 1100 is inserted into a wearer's ear. As such, the sound output is unhindered while still enabling the sealing structure 1106 to form a seal with the wearer's ear, blocking outside or environmental noises.

Figure 12:
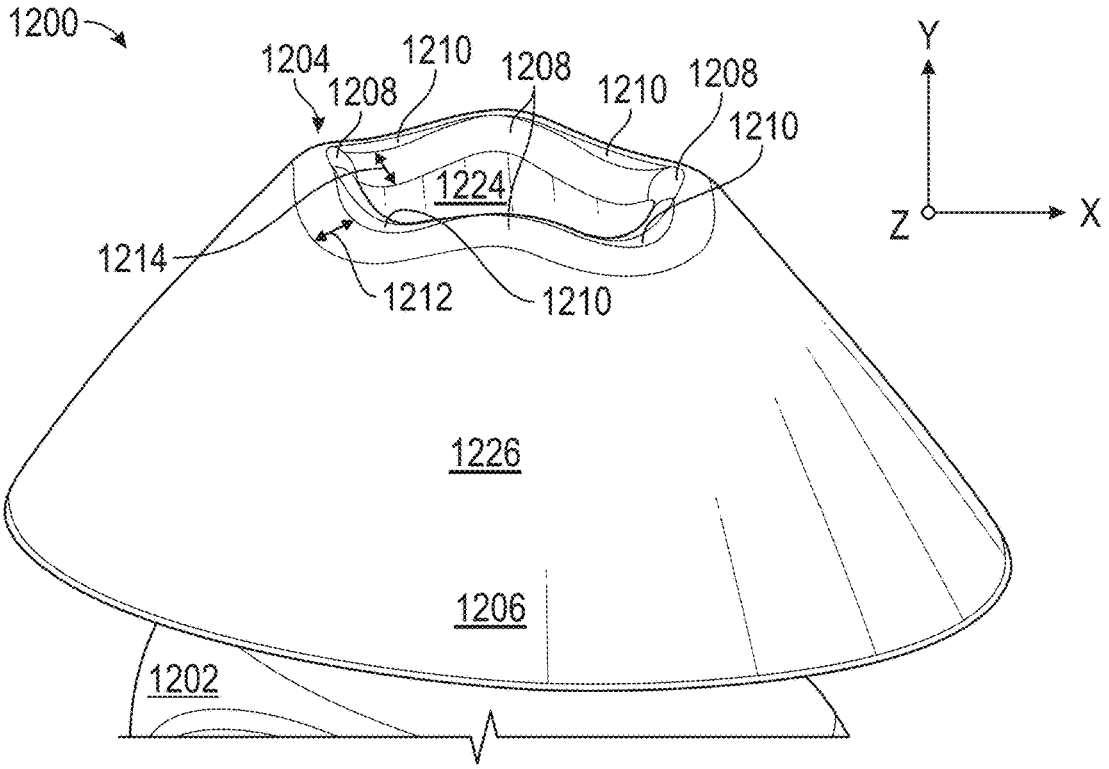
FIG. 12 is a side view of a nozzle having a non-planar distal end, according to an example.

FIG. 12 is a side view of an ear tip 1200 comprising a nozzle 1202 having a non-planar distal surface 1204, according to another example. The nozzle 1202 is coupled to a sealing structure 1206 at the non-planar distal surface 1204. The non-planar distal surface 1204 comprises a series of peaks 1208 and valleys 1210. The peaks 1208 extend in the y-direction while the valleys 1210 extend in the −y-direction, as compared to a conventional planar surface of a nozzle. The peaks 1208 may each extend to a same or substantially similar height in the y-direction from the end of the nozzle 1202, and the valleys 1210 may each extend to a same or substantially similar height in the −y-direction from the end of the nozzle 1202.

In one aspect, the peaks 1208 extend between about 0.5 mm to about 1.5 mm in the y-direction and the valleys 1210 extend between about 0.5 mm to about 1.5 mm in the −y-direction. In another aspect, the distance from the tip of a peak 1208 to the bottom of an adjacent valley 1210 is about 2 mm to about 2.5 mm. In yet another aspect, the peaks 1208 extend about 0 mm in the y-direction and the valleys 1210 extend between about 0.5 mm to about 2.5 mm in the −y-direction.

The peaks 1208 and valleys 1210 together give the non-planar distal surface 1204 a sinusoidal shape. An outer surface 1212 of the valleys 1210 of the non-planar distal surface 1204 may be angled towards the sealing structure 1206 in the z-direction. Similarly, an inner surface 1214 of the valleys 1210 of the non-planar distal surface 1204 may be angled towards the nozzle 1202 in the −z-direction. The valleys 1210 extend from an outer surface 1226 of the sealing structure 1206 to an inner surface 1224 of the nozzle 1202.

The ear tip 1200 of FIG. 12 is similar to the ear tip 1100 of FIG. 11; however the ear tip 1200 has sharper peaks 1208 and deeper valleys 1210. Comparing the non-planar distal surface 1204 of FIG. 12 to the non-planar distal surface 1104 of FIG. 11, the peaks 1208 and valleys 1210 of the non-planar distal surface 1204 of FIG. 12 extend deeper, or are more severe (i.e., the peaks 1208 extend further in the y-direction while the valleys 1210 extend further in the −y-direction). In other words, the distance from the tip of a peak 1208 to an adjacent valley 1210 of FIG. 12 is greater than the distance from the tip of a peak 1108 to an adjacent valley 1110 of FIG. 11. Furthermore, while the tips of the peaks 1208 are rounded or curved, the tips of the peaks 1208 come to a sharper peak than the tips of the peaks 1108 of FIG. 11. The peaks 1208 have an overall narrower width in the x-direction than the peaks 1108 of FIG. 11.

In FIG. 12, four peaks 1208 and four valleys 1210 are shown. However, the non-planar distal surface 1204 may comprise any suitable number of peaks 1208 and valleys 1210. By including a nozzle 1202 comprising a non-planar distal surface 1204 made up of a series of peaks 1208 and valleys 1210, the non-planar distal surface 1204 of the nozzle 1202 is harder to block when the ear tip 1200 is inserted into a wearer's ear. As such, the sound output is unhindered while still enabling the sealing structure 1206 to form a seal with the wearer's ear, blocking outside or environmental noises.

Figure 13:
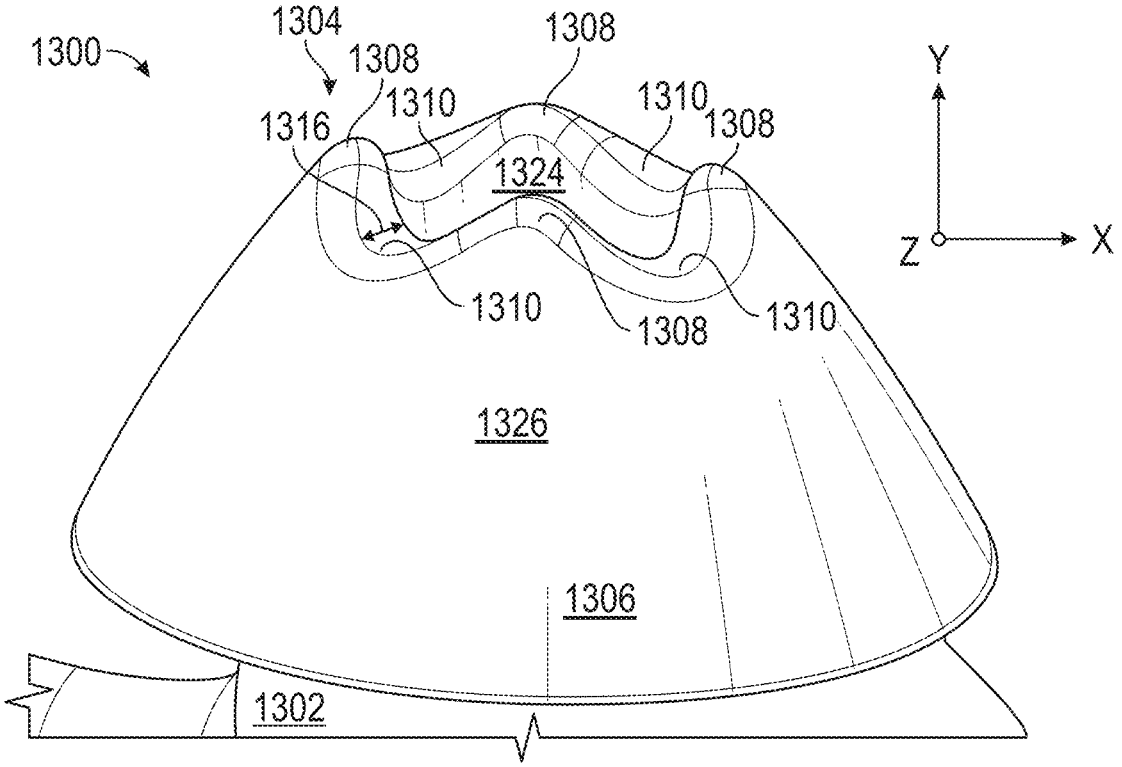
FIG. 13 is a side view of a nozzle having a non-planar distal end, according to yet another example.

FIG. 13 is a side view of an ear tip 1300 comprising a nozzle 1302 having a non-planar distal surface 1304, according to yet another example. The nozzle 1302 is coupled to a sealing structure 1306 at the non-planar distal surface 1304. The non-planar distal surface 1304 comprises a series of peaks 1308 and valleys 1310. The peaks 1308 extend in the y-direction while the valleys 1310 extend in the −y-direction, as compared to a conventional planar surface of a nozzle. The peaks 1308 may each extend to a same or substantially similar height in the y-direction from the end of the nozzle 1302, and the valleys 1310 may each extend to a same or substantially similar height in the −y-direction from the end of the nozzle 1302. The peaks 1308 and valleys 1310 together give the non-planar distal surface 1304 a sinusoidal shape.

In one aspect, the peaks 1308 extend between about 0.5 mm to about 1.5 mm in the y-direction and the valleys 1310 extend between about 0.5 mm to about 1.5 mm in the −y-direction. In another aspect, the distance from the tip of a peak 1308 to the bottom of an adjacent valley 1310 is about 2 mm to about 2.5 mm. In yet another aspect, the peaks 1308 extend about 0 mm in the y-direction and the valleys 1310 extend between about 0.5 mm to about 2.5 mm in the −y-direction.

While the tips of each peak 1308 come to a subtle point, each valley 1310 may have a substantially flat bottom 1316 facing the y-direction having a width in the z-direction greater than a width of the tips of the peaks 1308. An outer surface of the valleys 1310 of the non-planar distal surface 1304 may be angled towards the sealing structure 1306 in the z-direction. Similarly, an inner surface of the valleys 1310 of the non-planar distal surface 1304 may be angled towards the nozzle 1302 in the −z-direction. The valleys 1310 extend from an outer surface 1326 of the sealing structure 1306 to an inner surface 1324 of the nozzle 1302.

The ear tip 1300 of FIG. 13 is similar to the ear tip 1200 of FIG. 12; however the ear tip 1300 has sharper peaks 1308 and deeper valleys 1310. Comparing the non-planar distal surface 1304 of FIG. 13 to the non-planar distal surface 1204 of FIG. 12, the peaks 1308 and valleys 1310 of the non-planar distal surface 1304 of FIG. 13 extend deeper, or are more severe (i.e., the peaks 1308 extend further in the y-direction while the valleys 1310 extend further in the −y-direction). In other words, the distance from the tip of a peak 1308 to an adjacent valley 1310 of FIG. 13 is greater than the distance from the tip of a peak 1208 to an adjacent valley 1210 of FIG. 12. Furthermore, while the tips of the peaks 1308 are rounded or curved, the tips of the peaks 1308 come to a sharper peak than the tips of the peaks 1208 of FIG. 12. The bottoms 1316 of the valleys 1310 of FIG. 13 also have a greater width in the z-direction than a bottom of the valleys 1210 of FIG. 12. Moreover, the peaks 1308 have an overall narrower width in the x-direction than the peaks 1208 of FIG. 12.

In FIG. 13, four peaks 1308 and four valleys 1310 are shown. However, the non-planar distal surface 1304 may comprise any suitable number of peaks 1308 and valleys 1310. By including a nozzle 1302 comprising a non-planar distal surface 1304 made up of a series of peaks 1308 and valleys 1310, the non-planar distal surface 1304 of the nozzle 1302 is harder to block when the ear tip 1300 is inserted into a wearer's ear. As such, the sound output is unhindered while still enabling the sealing structure 1306 to form a seal with the wearer's ear, blocking outside or environmental noises.

Figure 14A:
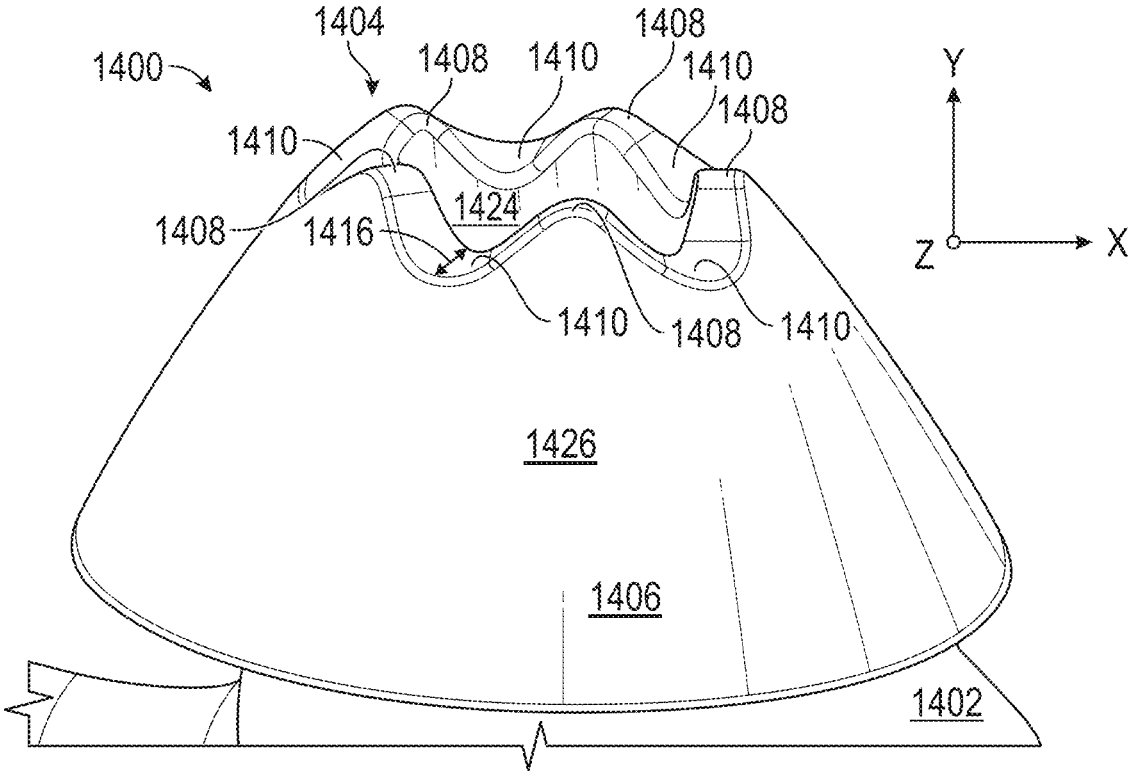
FIGS. 14A-B are each side views of a nozzle having a non-planar distal end, according to aspects.
Figure 14B:
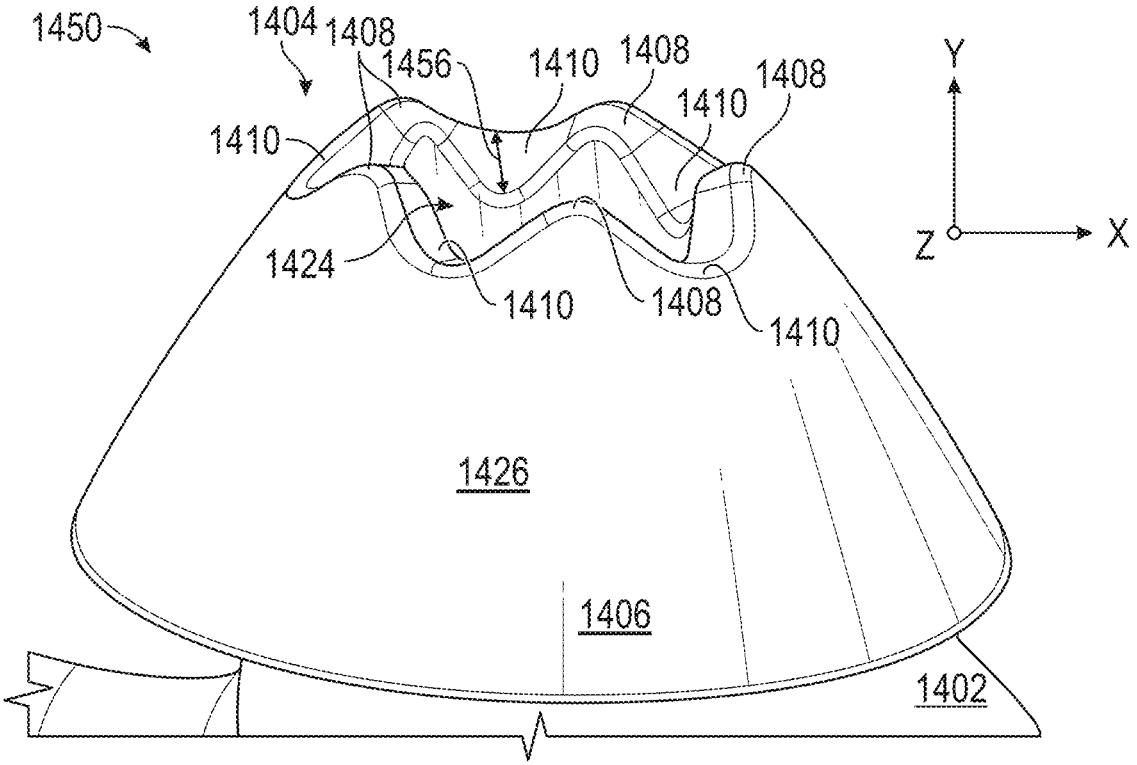

FIGS. 14A-14B are side views of ear tips 1400, 1450, respectively, comprising a nozzle having a non-planar distal surface 1404, according to one example. In the ear tips 1400, 1450 of FIGS. 14A-14B, the nozzle 1402 is coupled to a sealing structure 1406 at the non-planar distal surface 1404. The non-planar distal surface 1404 comprises a series of peaks 1408 and valleys 1410. The peaks 1408 extend in the y-direction while the valleys 1410 extend in the −y-direction, as compared to a conventional planar surface of a nozzle. The peaks 1408 may each extend to a same or substantially similar height in the y-direction from the end of the nozzle 1402, and the valleys 1410 may each extend to a same or substantially similar height in the −y-direction from the end of the nozzle 1402. The peaks 1408 and valleys 1410 together give the non-planar distal surface 1404 a sinusoidal shape. The valleys 1410 extend from an outer surface 1426 of the sealing structure 1406 to an inner surface 1424 of the nozzle 1402.

In one aspect, the peaks 1408 extend between about 0.5 mm to about 1.5 mm in the y-direction and the valleys 1410 extend between about 0.5 mm to about 1.5 mm in the −y-direction. In another aspect, the distance from the tip of a peak 1408 to the bottom of an adjacent valley 1410 is about 2 mm to about 2.5 mm. In yet another aspect, the peaks 1408 extend about 0 mm in the y-direction and the valleys 1410 extend between about 0.5 mm to about 2.5 mm in the −y-direction.

In the ear tip 1400 of FIG. 14A, while the tips of each peak 1408 come to a point, each valley 1410 may have a substantially flat bottom 1416 facing the y-direction having a width in the z-direction greater than a width of the tips of the peaks 1408. The ear tip 1450 of FIG. 14B is similar to the ear tip 1400 of FIG. 14A; however, the valleys 1410 of the ear tip 1450 of FIG. 14B have an angled bottom 1456 in the z-direction directed downwards towards the nozzle 1402. Thus, the valleys 1410 of the ear tip 1400 of FIG. 14A have a substantially flat bottom 1416 while the valleys 1410 of the ear tip 1450 of FIG. 14B have an angled bottom 1456.

Comparing the non-planar distal surface 1404 of FIGS. 14A-14B to the non-planar distal surface 1304 of FIG. 13, the peaks 1408 and valleys 1410 of the non-planar distal surface 1404 of FIG. 14A extend deeper, or are more severe (i.e., the peaks 1408 extend further in the y-direction while the valleys 1410 extend further in the −y-direction). In other words, the distance from the tip of a peak 1408 to an adjacent valley 1410 of FIGS. 14A-14B is greater than the distance from the tip of a peak 1308 to an adjacent valley 1310 of FIG. 13. Furthermore, while the tips of the peaks 1408 are rounded or curved, the tips of the peaks 1408 come to a sharper peak than the tips of the peaks 1308 of FIG. 13. The bottoms 1416 of the valleys 1410 of FIG. 14A and the bottoms 1456 of the valleys 1410 of FIG. 14B both have a greater width in the z-direction than the width of the bottoms 1316 of the valleys 1310 of FIG. 13. Moreover, the peaks 1408 have an overall narrower width in the x-direction than the peaks 1308 of FIG. 13.

In FIGS. 14A-14B, five peaks 1408 and five valleys 1410 are shown. However, the non-planar distal surface 1404 may comprise any suitable number of peaks 1408 and valleys 1410. By including a nozzle 1402 comprising a non-planar distal surface 1404 made up of a series of peaks 1408 and valleys 1410, the non-planar distal surface 1404 of the nozzle 1402 is harder to block when the ear tip 1400 is inserted into a wearer's ear. As such, the sound output is unhindered while still enabling the sealing structure 1406 to form a seal with the wearer's ear, blocking outside or environmental noises.

Figure 15:
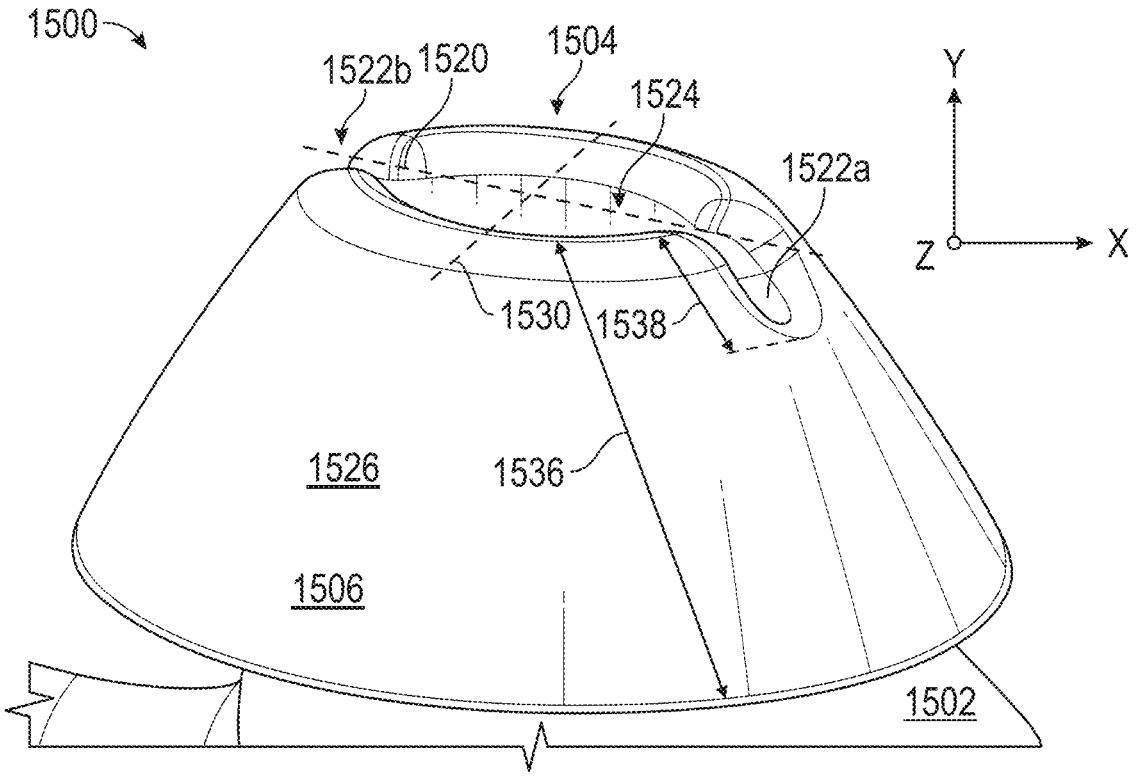
FIG. 15 is a side view of a nozzle having a non-planar distal end, according to another example.

FIG. 15 is a side view of an ear tip 1500 comprising a nozzle 1502 having a non-planar distal surface 1504, according to another example. The nozzle 1502 is coupled to a sealing structure 1506 at the non-planar distal surface 1504. The non-planar distal surface 1504 has an elliptical shape having a major axis 1520 and a minor axis 1530. The major axis 1520 of the elliptical shape is substantially aligned with the major axis of the wearer's ear canal (see FIG. 1B for reference) when the ear tip 1500 is positioned in the wearer's ear (e.g., the major axis 1520 of the elliptical shape is aligned with the length of the wearer's head). FIG. 1B illustrates the major axis and the minor axis of the wearer's ear canal. As shown in FIG. 1B, the major axis is disposed along the y-axis, and the minor axis is disposed along the z-axis.

A first notch 1522*a* and a second notch 1522*b* (collectively referred to as notches 1522) are disposed on the major axis 1520 of the non-planar distal surface 1504. Thus, when the ear tip 1500 is placed in the wearer's ear canal, the notches 1522 are placed at the top and bottom of the wearer's ear canal, aligned with the major axis of the wearer's ear canal. The notches 1522 extend from an outer surface 1526 of the sealing structure 1506 to an inner surface 1524 of the nozzle 1502 in the z-direction. The notches 1522 have a depth or length 1538 in the y-direction extending down the sealing structure 1506 less than a length 1536 of the sealing structure 1506. In one aspect, the notches 1522 each extend between about 0.5 mm to about 2.5 mm in the −y-direction. In one example, the notches 1522 have a depth or length 1538 about one-fourth to about one-third of the length 1536 of the sealing structure 1506. The surfaces adjacent to the notches 1522 on the non-planar distal surface

1504 are substantially planar. The notches 1522 may each extend to a same or substantially similar height in the −y-direction from the end of the nozzle 1502.

The notches 1522 of FIG. 15 are more discrete than the peaks and valleys of FIGS. 11-14B. In FIG. 15, two notches 1522 are shown. However, the non-planar distal surface 1504 may comprise any suitable number of notches 1522. For example, one or more notches may be included on the minor axis 1530 of the ear tip 1500. By including a nozzle 1502 comprising a non-planar distal surface 1504 having notches 1522 disposed on the major axis 1520, the non-planar distal surface 1504 of the nozzle 1502 is harder to block when the ear tip 1500 is inserted into a wearer's ear. As such, the sound output is unhindered while still enabling the sealing structure 1506 to form a seal with the wearer's ear, blocking outside or environmental noises.

Figure 16:
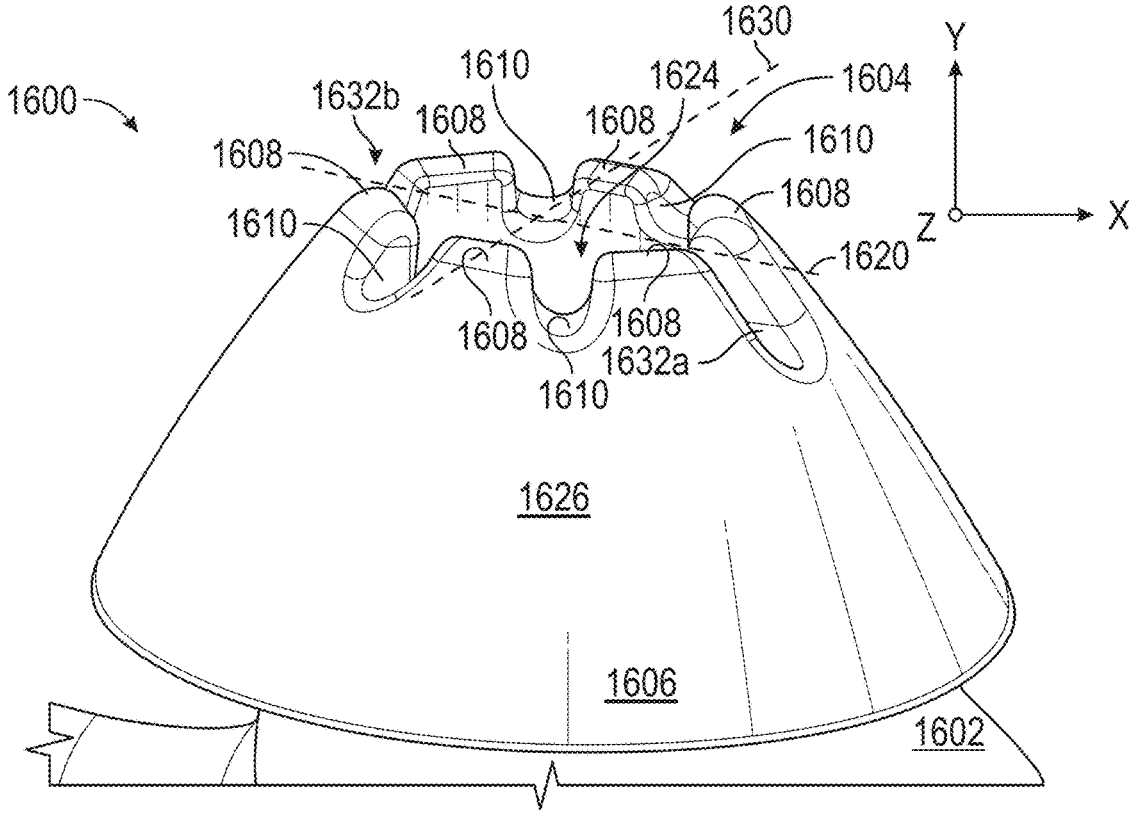
FIG. 16 is a side view of a nozzle having a non-planar distal end, according to yet another example.

FIG. 16 is a side view of an ear tip 1600 comprising a nozzle 1602 having a non-planar distal surface 1604, according to yet another example. The nozzle 1602 is coupled to a sealing structure 1606 at the non-planar distal surface 1604. The non-planar distal surface 1604 has an elliptical shape having a major axis 1620 and a minor axis 1630. The major axis 1620 of the elliptical shape is substantially aligned with the major axis of the wearer's ear canal (see FIG. 1B for reference) when the ear tip 1600 is positioned in the wearer's ear (e.g., the major axis 1620 of the elliptical shape is aligned with the length of the wearer's head).

The non-planar distal surface 1604 comprises a series of plateaus 1608, first valleys 1610, and one or more second valleys 1632*a*, 1632*b* (collectively referred to as second valleys 1632). The plateaus 1608 have a substantially planar surface. The one or more second valleys 1632 are disposed on the major axis 1620 of the ear tip 1600 and the first valleys 1610 are offset from the major axis 1620. The first and second valleys 1610, 1632 extend from an outer surface 1626 of the sealing structure 1606 to an inner surface 1624 of the nozzle 1602. The first and second valleys 1610, 1632 extend down the sealing structure 1606 and nozzle 1602 in the −y-direction. The one or more second valleys 1632 have a greater depth or length in the −y-direction than the first valleys 1610. The plateaus 1608 may each extend to a same or substantially similar height in the y-direction from the end of the nozzle 1602, the first valleys 1610 may each extend to a same or substantially similar height in the −y-direction from the end of the nozzle 1602, and the second valleys 1632 may each extend to a same or substantially similar height in the −y-direction from the end of the nozzle 1602.

In one aspect, the plateaus 1608 extend between about 0.5 mm to about 1.5 mm in the y-direction, the first valleys 1610 extend between about 0.5 mm to about 1.5 mm in the −y-direction, and the second valleys 1632 extend about 1.5 mm to about 2.5 mm in the −y-direction. In another aspect, the plateaus 1608 extend about 0 mm in the y-direction, the first valleys 1610 extend between about 0.5 mm to about 1.5 mm in the −y-direction, and the second valleys 1632 extend about 1.5 mm to about 2.5 mm in the −y-direction. For example, the second valleys 1632 may extend about 2.2 mm in the −y-direction.

In FIG. 16, six plateaus 1608, two first valleys 1610, and two second valleys 1632 are shown. However, the non-planar distal surface 1604 may comprise any suitable number of plateaus 1608, first valleys 1610, and second valleys 1632. For example, only one second valley 1632 may be included on the major axis 1620 while seven first valleys 1610 are included. By including a nozzle 1602 comprising a non-planar distal surface 1604 made up of a series of plateaus 1608 and first and second valleys 1610, 1632 the non-planar distal surface 1604 of the nozzle 1602 is harder to block when the ear tip 1600 is inserted into a wearer's ear. Furthermore, including one or more second valleys 1632 on the major axis 1620 makes the non-planar distal surface 1604 even more difficult to block. As such, the sound output is unhindered while still enabling the sealing structure 1606 to form a seal with the wearer's ear, blocking outside or environmental noises.

Figure 17:
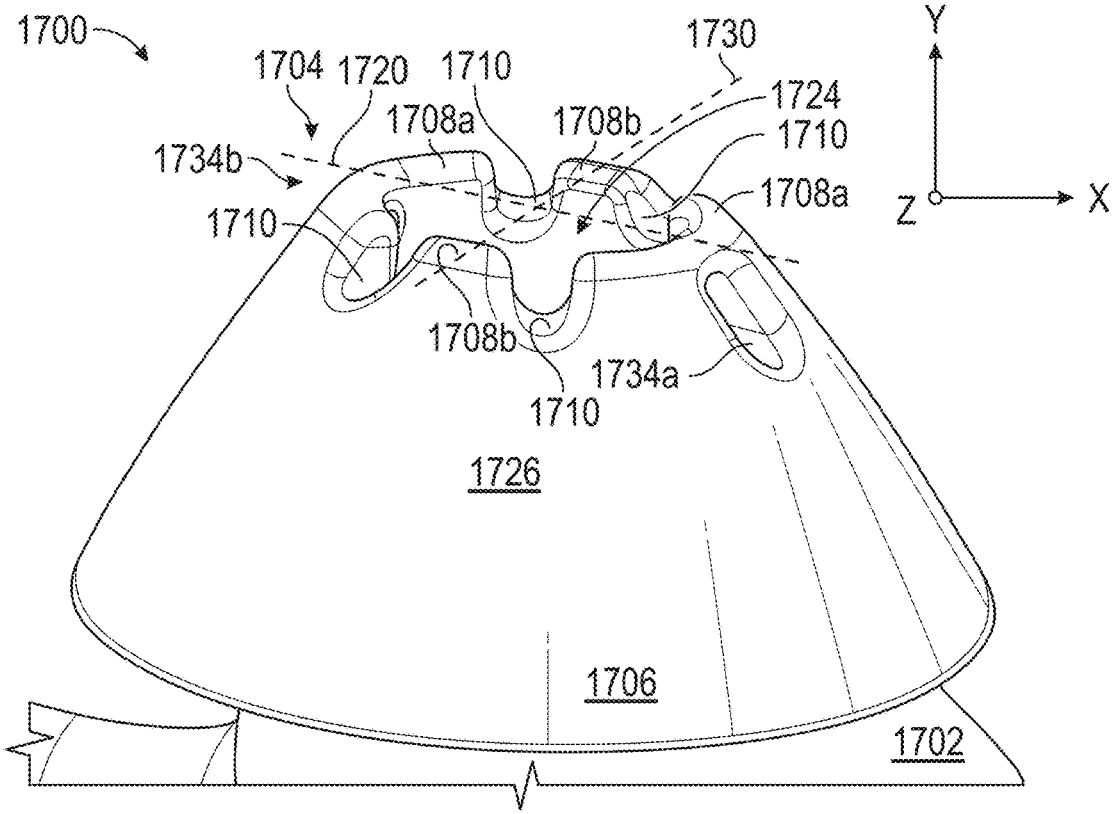
FIG. 17 is a side view of a nozzle having a non-planar distal end, according to another example.

FIG. 17 is a side view of an ear tip 1700 comprising a nozzle 1702 having a non-planar distal surface 1704, according to another example. The nozzle 1702 is coupled to a sealing structure 1706 at the non-planar distal surface 1704. The non-planar distal surface 1704 has an elliptical shape having a major axis 1720 and a minor axis 1730. The major axis 1720 of the elliptical shape is substantially aligned with the major axis of the wearer's ear canal (see FIG. 1B for reference) when the ear tip 1700 is positioned in the wearer's ear (e.g., the major axis 1720 of the elliptical shape is aligned with the length of the wearer's head).

The non-planar distal surface 1704 comprises a series of plateaus 1708*a*, 1708*b*, valleys 1710, and one or more holes 1734*a*, 1734*b* (collectively referred to as holes 1734). The plateaus 1708*a*, 1708*b* have a substantially planar surface. The one or more holes 1734 are disposed on the major axis 1720 of the ear tip 1700 and the valleys 1710 are offset from the major axis 1720. The valleys 1710 and the one or more holes 1734 extend from an outer surface 1726 of the sealing structure 1706 to an inner surface 1724 of the nozzle 1702. The valleys 1710 and the one or more holes 1734 extend down the sealing structure 1706 and nozzle 1702 in the −y-direction.

The one or more holes 1734 are disposed below the plateaus 1708*a*, 1708*b* or are recessed from the non-planar distal surface 1704. The one or more holes 1734 may extend further down the sealing structure 1706 in the y-direction than the valleys 1710. One or more of the plateaus 1708*a* disposed adjacent to the one or more holes 1734 may have a greater length in the x-direction than one or more shorter plateaus 1708*b* disposed adjacent to or between the valleys 1710. The plateaus 1708*a*, 1708*b* may each extend to a same or substantially similar height in the y-direction from the end of the nozzle 1702, and the valleys 1710 may each extend to a same or substantially similar height in the −y-direction from the end of the nozzle 1702. The one or more holes 1734 may have the same or substantially same size and shape.

In one aspect, the plateaus 1708 extend between about 0.5 mm to about 1.5 mm in the y-direction, the valleys 1710 extend between about 0.5 mm to about 1.5 mm in the −y-direction, and the one or more holes 1734 are recessed about 0.3 mm to about 1.5 mm from the non-planar distal surface 1734. The one or more holes 1734 may have a height of about 1.2 mm to about 1.6 mm and a width of about 0.8 mm to about 1.2 mm. The one or more holes 1734 may have an oval or oblong shape.

In FIG. 17, two holes 1734, two longer plateaus 1708*a*, and two shorter plateaus 1708*b* are shown. However, the non-planar distal surface 1704 may comprise any suitable number of plateaus 1708*a*, 1708*b* of any length, valleys 1710, and holes 1734. For example, only one hole 1734 may be included on the major axis 1720 while more valleys 1710 are included. In another example, only one or more holes 1734 may be included adjacent to one or more plateaus 1708*a*, 1708*b*, and zero or no valleys 1710 may be included. In such an example, the non-planar distal surface 1704 of the nozzle 1072 may look similar to the non-planar distal surface 1504 of the ear tip 1500 of FIG. 15; however, rather than including notches 1522, the ear tip 1700 comprises one or more holes 1734 disposed on the major axis 1720.

By including a nozzle 1702 comprising a non-planar distal surface 1704 made up of a series of plateaus 1708, valleys 1710, and holes 1732, the non-planar distal surface 1704 of the nozzle 1702 is harder to block when the ear tip 1700 is inserted into a wearer's ear. Furthermore, including one or more holes 1734 on the major axis 1720 makes the non-planar distal surface 1704 even more difficult to block. As such, the sound output is unhindered while still enabling the sealing structure 1706 to form a seal with the wearer's ear, blocking outside or environmental noises.

Figure 18A:
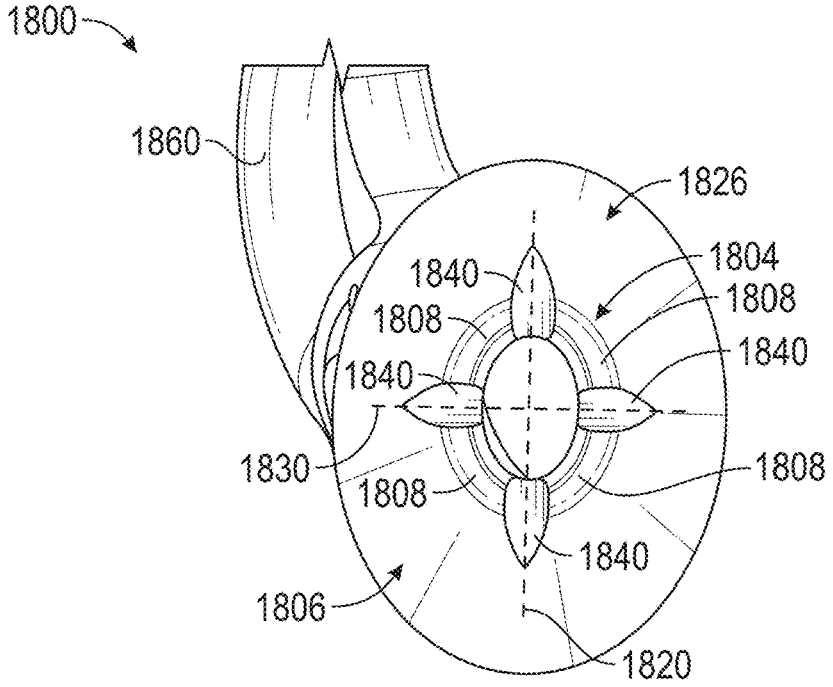
FIGS. 18A-18C are views of a nozzle having a non-planar distal end, according to yet another example.
Figure 18B:
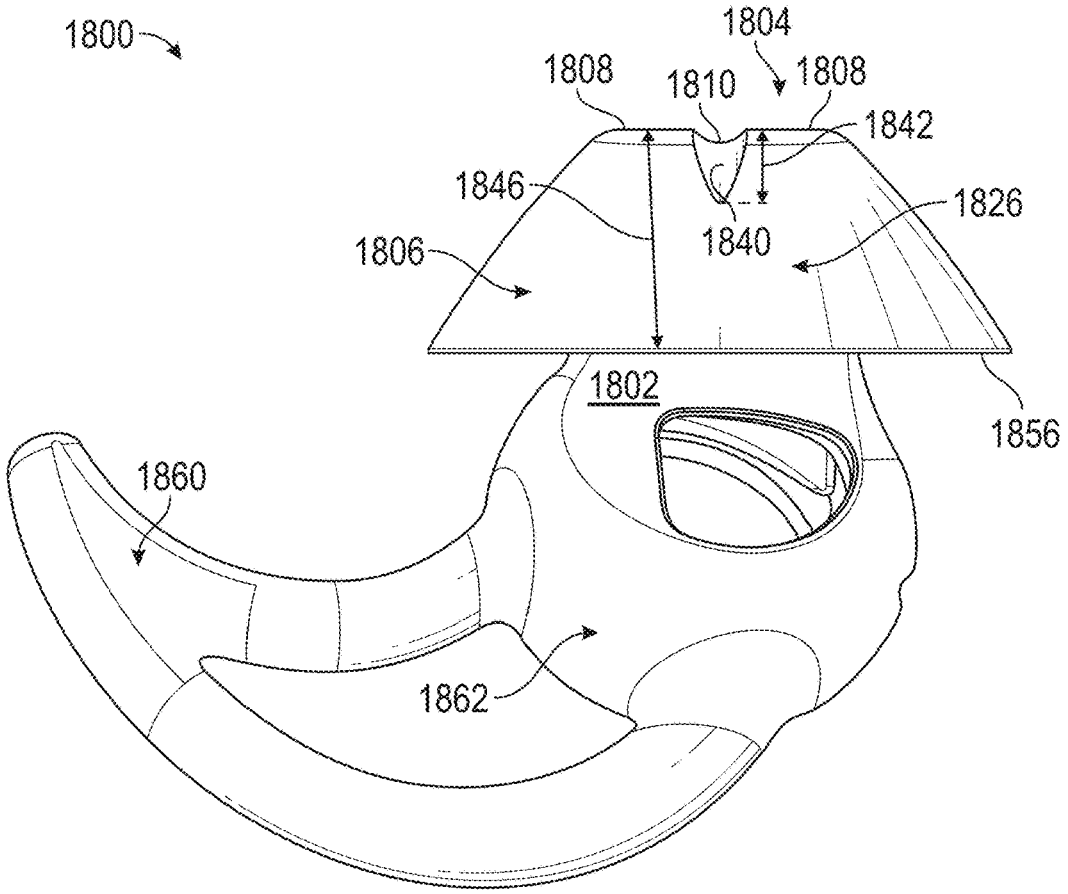
Figure 18C:
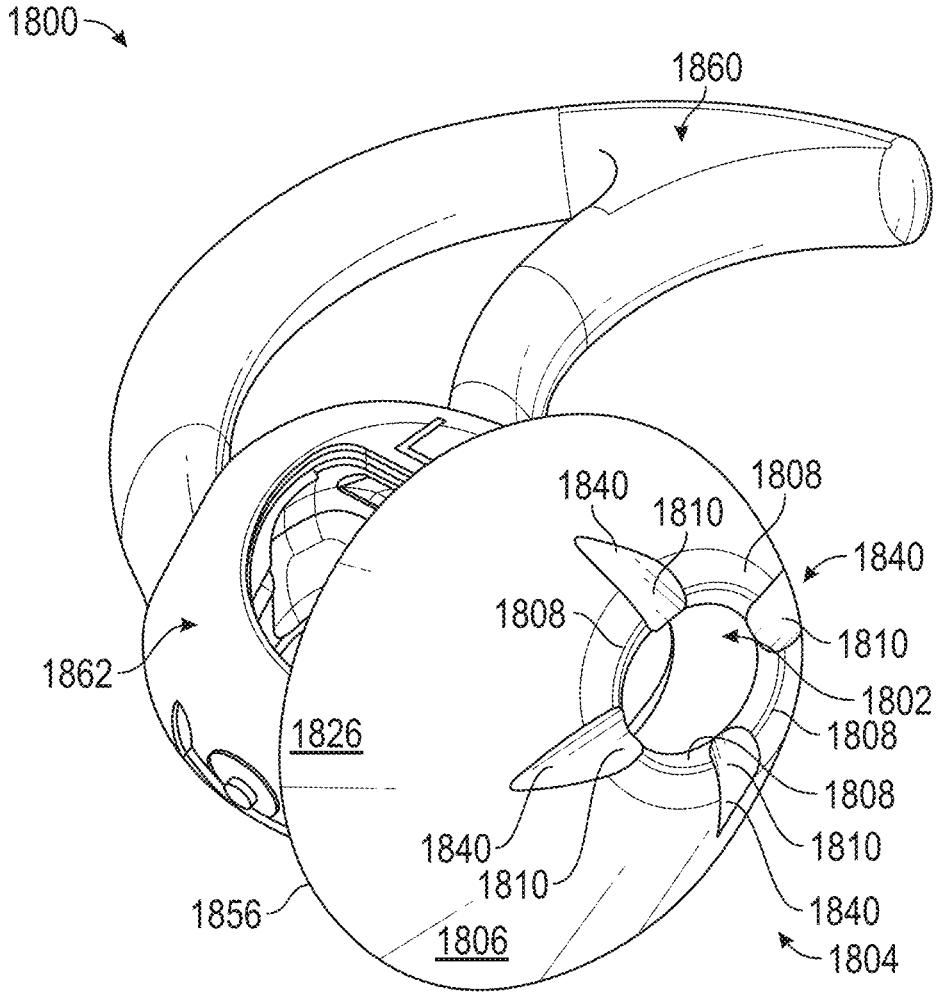

FIGS. 18A-18C are views of an ear tip 1800 comprising a nozzle 1802 having a non-planar distal surface 1804, according to yet another example. FIG. 18A illustrates a front view of the ear tip 1800, FIG. 18B illustrates a side view of the ear tip 1800, and FIG. 18C illustrates a perspective view of the ear tip 1800. The ear tip 1800 is coupled to a retaining structure 1860 and a body 1862.

The nozzle 1802 is coupled to a sealing structure 1806 at the non-planar distal surface 1804. The non-planar distal surface 1804 has an elliptical shape having a major axis 1820 and a minor axis 1830. The major axis 1820 of the elliptical shape is substantially aligned with the major axis of the wearer's ear canal (see FIG. 1B for reference) when the ear tip 1800 is positioned in the wearer's ear (e.g., the major axis 1820 of the elliptical shape is aligned with the length of the wearer's head).

The non-planar distal surface 1804 comprises a plurality of valleys 1810, each coupled to a channel 1840. A plateau 1808 is disposed between each valley 1810. The valleys 1810 are disposed on the non-planar distal surface 1804 while the channels 1840 extend partially down an outer surface 1826 of the sealing structure 1806. The channels 1840 taper off prior to reaching a surface 1856 of the sealing structure 1806 disposed opposite the non-planar distal surface 1804. The valleys 1810 have a greater width than the channels 1840 such that the valleys 1810 and channels 1840 get smaller further down the sealing structure 1806 (e.g., the channels 1840 fade out).

Each channel 1840 has a length 1842 less than a length 1846 of the sealing structure 1806. The length of the sealing structure 1806 is considered to be from a plateau 1808 of the non-planar distal surface 1804 to the surface 1856 disposed opposite the non-planar distal surface 1804. The length 1842 of each channel 1840 may be about one-fourth to one-half of the length 1846 of the sealing structure 1806, such as about one-third. The channels 1840 are shallow, and do not extend through the sealing structure 1806. Each channel 1840 may have a parabolic shape. The plateaus 1808 may each extend to a same or substantially similar height from the end of the nozzle 1802, the valleys 1810 may each extend to a same or substantially similar height from the end of the nozzle 1802, and the channels 1840 may each extend to a same or substantially similar height or length from the end of the nozzle 1802.

In FIG. 18, four valleys 1810 and four channels 1840 are shown, with two valleys 1810 and two channels 1840 disposed on the major axis 1820, and two valleys 1810 and two channels 1840 disposed on the minor axis 1830. Four plateaus 1808 are shown disposed between each valley 1810. However, the non-planar distal surface 1804 may comprise any suitable number of valleys 1810, channels 1840, and plateaus 1808. For example, two valleys 1810 and two channels 1840 may be included on the major axis 1820 with only two plateaus 1808 disposed between the valleys 1810. In such an example, zero or no valleys 1810 and zero or no channels 1840 are disposed on the minor axis 1830.

By including a nozzle 1802 comprising a non-planar distal surface 1804 made up of a series of plateaus 1808, valleys 1810, and channels 1840, the non-planar distal surface 1804 of the nozzle 1802 is harder to block when the ear tip 1800 is inserted into a wearer's ear. Furthermore, including one or more channels 1840 on at least the major axis 1820 makes the non-planar distal surface 1804 even more difficult to block. Thus, even if the valleys 1810 of the non-planar distal end 1804 are inadvertently blocked by a wearer's ear, the one or more channels 1840 are able to provide an air path while allowing the sealing structure 1806 to form a seal with the wearer's ear. As such, the sound output is unhindered while still enabling the sealing structure 1806 to form a seal with the wearer's ear, blocking outside or environmental noises.

As discussed above, a non-planar design, such as the example illustrated in FIGS. 11-18C, make it more unlikely that the end of the nozzle may be sealed off or substantially sealed off from air flow, e.g., during positioning of the earbud in the wearer's ear. As such, utilizing the ear tips described in FIGS. 11-18C result in a more enjoyable experience for the wearer, as undesirable high-pitched noises or squeals are prevented from being output.

The earpiece described herein includes a tip that provides orientation, stability, and good sealing to the entrance to the ear canal and to the ear structure outside the ear canal, without excessive radial pressure, and without inward clamping pressure provided by a source not included in the earpiece.

The earpiece described herein is applicable to a variety of devices, including audio headphones, hearing aids, hearing assistance headphones, noise-masking earbuds, ANR headphones, aviation headphones, and other devices that include a structure for interfacing with a wearer's ear.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An ear tip for an in-ear earpiece, comprising:

a body shaped to fit in the lower concha of a wearer's ear;

a nozzle extending towards the ear canal of the wearer's ear and comprising a distal end, the nozzle including an acoustic passage to conduct sound waves to the ear canal of the wearer, wherein at least a portion of the distal end of the nozzle comprises a non-planar surface, the non-planar surface comprising a series of plateaus and valleys or a series of peaks and valleys; and a sealing structure extending from the non-planar surface of the nozzle, wherein the valleys extends through an outer surface of the sealing structure to an inner surface of the nozzle such that the valleys are recessed from the peaks or the plateaus, and wherein the valleys each have a bottom surface disposed parallel to a first surface of the sealing structure disposed opposite the non-planar surface and an outer surface disposed at an angle to the first surface of the sealing structure.

2. The ear tip of claim 1, wherein the non-planar surface is closer to the ear canal of the wearer than the body of the ear tip when the ear tip is positioned in the wearer's ear.

3. The ear tip of claim 1, wherein the non-planar surface of the distal end has an elliptical shape, wherein the major axis of the elliptical shape is substantially aligned with the major axis of the wearer's ear canal when the ear tip is positioned in the wearer's ear.

4. The ear tip of claim 3, wherein one or more holes are recessed from the non-planar surface of the distal end, the one or more holes being disposed on the major axis of the elliptical shape.

5. The ear tip of claim 1, wherein the non-planar surface has a sinusoidal shape.

6. The ear tip of claim 1, further comprising a curved retaining structure extending from the body, the retaining structure applying pressure to at least a portion of the antihelix of the wearer's ear when the ear tip is positioned in the wearer's ear, wherein the retaining structure comprises a leg that tapers in thickness from the body to the tip.

7. An ear tip for an in-ear earpiece, comprising:

a body shaped to fit in the lower concha of a wearer's ear;

a nozzle extending towards the ear canal of the wearer's ear and comprising a distal end, the nozzle including an acoustic passage to conduct sound waves to the ear canal of the wearer, wherein at least a portion of the distal end of the nozzle comprises a first surface disposed closer to the ear canal of the wearer than the body of the ear tip when the ear tip is positioned in the wearer's ear, and wherein the first surface comprises one or more valleys; and a sealing structure extending from the first surface of the nozzle, wherein the one or more valleys extend through an outer surface of the sealing structure to an inner surface of the nozzle such that the one or more valleys are recessed from at least a portion of the first surface, wherein the one or more valleys are each coupled to a channel extending partially down an outer surface of the sealing structure from the first surface, the channels having a shape that tapers off prior to reaching a first surface of the sealing structure opposite the first surface of the distal end, and wherein the channels have a length extending down the outer surface of the sealing structure greater than a width of the valleys.

8. The ear tip of claim 7, wherein the first surface of the distal end has an elliptical shape, wherein the major axis of the elliptical shape is substantially aligned with a major axis of the wearer's ear canal when the ear tip is positioned in the wearer's ear.

9. The ear tip of claim 7, further comprising a curved retaining structure extending from the body, the retaining structure applying pressure to at least a portion of the antihelix of the wearer's ear when the ear tip is positioned in the wearer's ear, wherein the retaining structure comprises a leg that tapers in thickness from the body to the tip.

10. An ear tip for an in-ear earpiece, comprising:

a body shaped to fit in the lower concha of a wearer's ear;

a nozzle extending towards the ear canal of the wearer's ear and comprising a distal end, the nozzle including an acoustic passage to conduct sound waves to the ear canal of the wearer, wherein at least a portion of the distal end of the nozzle comprises a non-planar surface, the non-planar surface comprising a series of plateaus and valleys, wherein the non-planar surface of the distal end has an elliptical shape, the major axis of the elliptical shape being substantially aligned with the major axis of the wearer's ear canal when the ear tip is positioned in the wearer's ear; and a sealing structure extending from the non-planar surface of the nozzle, wherein the valleys extends through an outer surface of the sealing structure to an inner surface of the nozzle such that the valleys are recessed from the plateaus, and wherein one or more first valleys are one or more notches disposed on the major axis of the elliptical shape.

11. The ear tip of claim 10, wherein the one or more first valleys have a greater depth than one or more second valleys offset from the major axis of the elliptical shape.

12. The ear tip of claim 11, wherein the one or more first valleys have a first depth between about 1.5 mm to about 2.5 mm, and wherein the one or more second valleys have a second depth between about 0.5 mm to about 1.5 mm.

13. The ear tip of claim 10, wherein the one or more notches have a length about one-fourth to about one-third of a length of the sealing structure.

14. The ear tip of claim 7, wherein the length of the channels is about one-fourth to about one-half the length of the outer surface of the sealing structure.

15. The ear tip of claim 7, wherein each channel has a parabolic shape, and wherein each channel fails to extend through the outer surface of the sealing structure.

16. The ear tip of claim 8, wherein one or more first valleys are disposed on the major axis of the elliptical shape.

17. The ear tip of claim 8, wherein one or more second valleys are disposed on a minor axis of the elliptical shape.

18. The ear tip of claim 1, wherein the series of peaks and valleys comprise at least four peaks.

19. The ear tip of claim 1, wherein the valleys have a depth between about 0.5 mm to about 2.5 mm.

* * * * *